US007927122B2

(12) United States Patent
Yamaji et al.

(10) Patent No.: US 7,927,122 B2
(45) Date of Patent: Apr. 19, 2011

(54) CONNECTOR ASSEMBLY HAVING AN IMPROVED CONNECTION MECHANISM

(75) Inventors: Takahiro Yamaji, Tokyo (JP); Masakazu Kuroiwa, Tokyo (JP); Tomomi Sakata, Hirosaki (JP); Akira Kimura, Hirosaki (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/802,788

(22) Filed: Jun. 14, 2010

(65) Prior Publication Data

US 2011/0008975 A1 Jan. 13, 2011

(30) Foreign Application Priority Data

Jul. 7, 2009 (JP) ..... 2009-161276

(51) Int. Cl.
*H01R 13/625* (2006.01)

(52) U.S. Cl. ..... 439/342; 439/376

(58) Field of Classification Search ..... 439/342, 439/376

See application file for complete search history.

(56) References Cited

U.S. PATENT DOCUMENTS 5,586,901 A * 12/1996 Muta ..... 439/342
5,816,839 A * 10/1998 Muta ..... 439/342
6,217,363 B1 * 4/2001 Takata ..... 439/342
6,231,372 B1 * 5/2001 Doshita et al. ..... 439/376
6,948,953 B2 * 9/2005 Fukamachi ..... 439/137
2001/0036765 A1 * 11/2001 Okabe et al. ..... 439/342

FOREIGN PATENT DOCUMENTS

JP 2008-140555 6/2008
JP 2008-258112 10/2008

* cited by examiner

*Primary Examiner* — Tho D Ta

(74) *Attorney, Agent, or Firm* — Collard & Roe, P.C.

(57) ABSTRACT

A connector assembly has a first connector and a second connector matable with the first connector. The first connector includes a first contact having a first contact portion and a first housing configured to hold the first contact. The second connector includes a second contact having a second contact portion that is brought into contact with the first contact portion and a second housing configured to hold the second contact. The connector assembly further includes a positioner operable to position the second contact portion in a first direction so that the second contact portion corresponds to the first contact portion when the second connector is moved relative to the first connector along the first direction. The connector assembly further includes a movement guide operable to guide a relative movement of the second connector relative to the first connector along a second direction perpendicular to the first direction in a state in which the second contact portion has been positioned in the first direction until the second contact portion is brought into contact with the first contact portion.

32 Claims, 17 Drawing Sheets

CONNECTOR ASSEMBLY HAVING AN IMPROVED CONNECTION MECHANISM

CROSS REFERENCE TO RELATED APPLICATIONS

Applicants claim priority under 35 U.S.C. §119 of Japanese Patent Application No. JP2009-161276 filed Jul. 7, 2009.

BACKGROUND OF THE INVENTION

The present invention relates to a connector assembly having two connectors, and more particularly to a connector assembly with a reduced height.

For example, connector assemblies for connecting a plurality of cables to a circuit board are disclosed in JP-A 2008-258112 and JP-A 2008-140555. Each of the connector assemblies has two connectors including a first connector mounted on a circuit board and a second connector to which cables are connected.

In the connector assembly disclosed in JP-A 2008-258112, the second connector is inserted into the first connector along the vertical direction (a direction perpendicular to the circuit board) and mated with the first connector. In the following description, this type of connector assemblies is referred to as a vertical-connection connector assembly. In the case of the vertical-connection connector assembly, large stress is applied to the circuit board when the second connecter is mated with the first connector. Therefore, problems such as deformation of the circuit board may arise.

Meanwhile, in the connector assembly disclosed in JP-A 2008-140555, the second connector is inserted into the first connector along the horizontal direction (a direction parallel to the circuit board) and mated with the first connector. In the following description, this type of connector assemblies is referred to as a horizontal-connection connector assembly. In the horizontal-connection connector assembly, stress applied to the circuit board when the second connector is mated with the first connector is reduced as compared to the vertical-connection connector assembly.

However, in the horizontal-connection connector assembly, an insertion hole formed in the first connector is narrowed as the height of the connector assembly is reduced. Accordingly, the workability of mating the first connector and the second connector is problematically deteriorated.

SUMMARY OF THE INVENTION

It is, therefore, an object of the present invention to provide a connector assembly exhibiting excellent workability with a reduced height.

A first aspect of the present invention provides a connector assembly having a first connector and a second connector matable with the first connector. The first connector includes a first contact having a first contact portion and a first housing configured to hold the first contact. The second connector includes a second contact having a second contact portion that is brought into contact with the first contact portion and a second housing configured to hold the second contact. The connector assembly further includes a positioner operable to position the second contact portion in a first direction so that the second contact portion corresponds to the first contact portion when the second connector is moved relative to the first connector along the first direction. The connector assembly further includes a movement guide operable to guide a relative movement of the second connector relative to the first connector along a second direction perpendicular to the first direction in a state in which the second contact portion has been positioned in the first direction until the second contact portion is brought into contact with the first contact portion.

A second aspect of the present invention provides the first connector in the aforementioned connector assembly.

A third aspect of the present invention provides the second connector in the aforementioned connector assembly.

An appreciation of the objectives of the present invention and a more complete understanding of its structure may be had by studying the following description of the preferred embodiment and by referring to the accompanying drawings.

Figure 1:
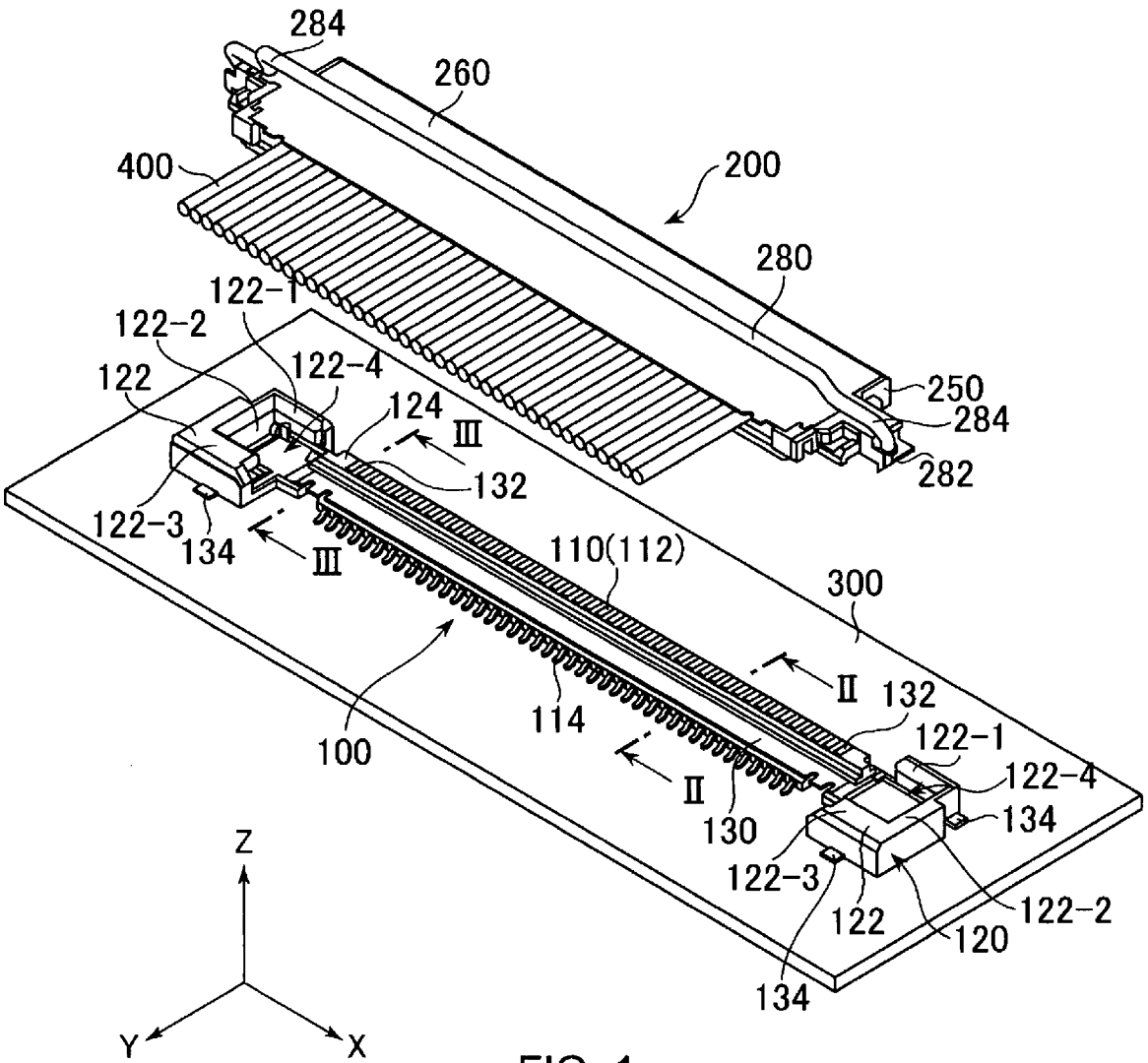
FIG. 1 is a perspective view showing a connector assembly having a first connector and a second connector according to a first embodiment of the present invention wherein the first connector and the second connector are separated from each other (not in a mating state).

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 2:
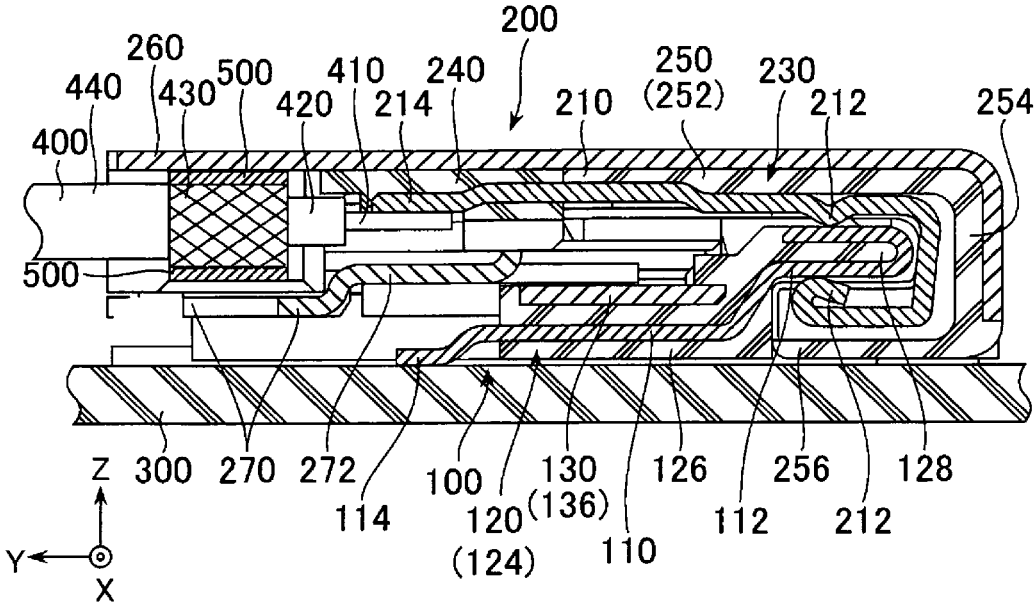
FIG. 2 is a cross-sectional view showing the connector assembly taken along line II-II of FIG. 1 wherein the first connector and the second connector are mated with each other.
Figure 3:
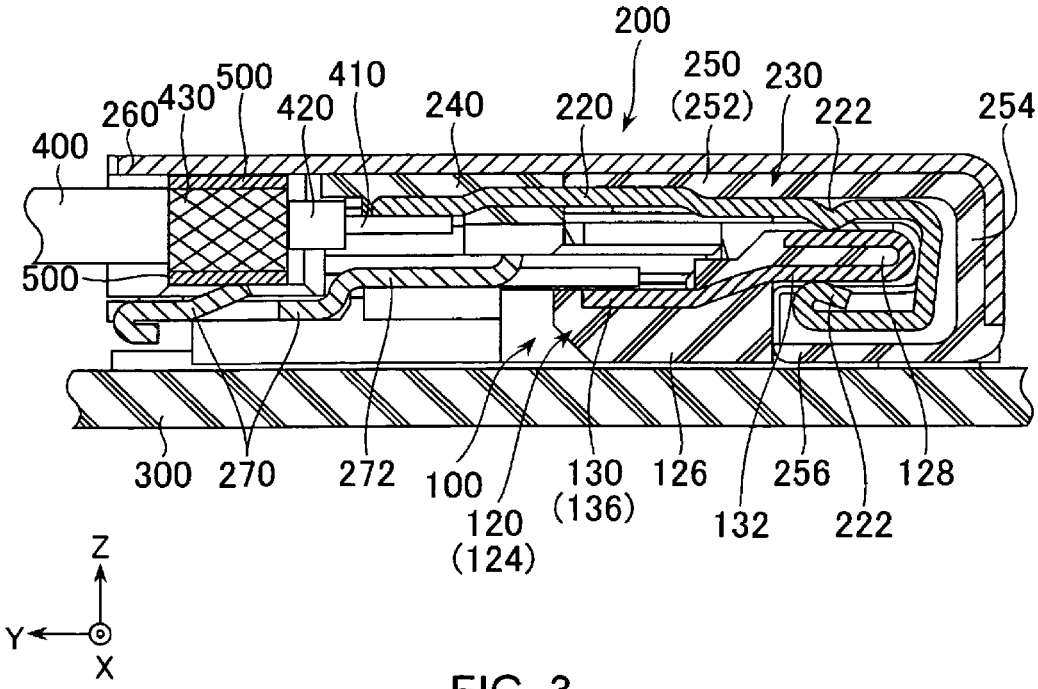
FIG. 3 is a cross-sectional view showing the connector assembly taken along line of FIG. 1 wherein the first connector and the second connector are mated with each other.
Figure 5:
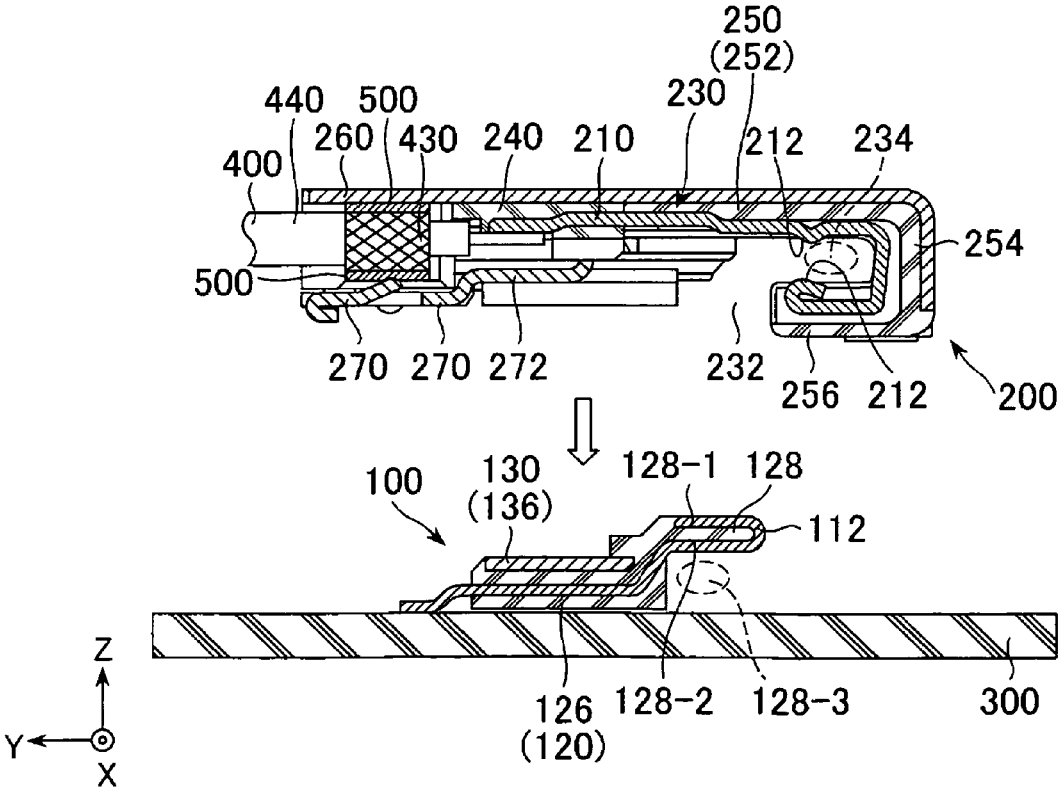
FIG. 5 is a cross-sectional view showing a step of a mating operation of the first connector and the second connector shown in FIG. 1.

As shown in FIG. 1, a connector assembly according to a first embodiment of the present invention includes a first connector 100 mounted on a circuit board 300 and a second connector 200 to which cables 400 are attached. For example, the cables 400 are coaxial thin wires. As shown in FIGS. 2, 3, and 5, each of the cables 400 includes a signal conductor 410, an insulator 420 covering the signal conductor 410, a ground conductor 430, and an insulative cover 440. In the present embodiment, a plurality of cables 400 are arranged in the X-direction, and a common conductive member 500 is fixed to the ground conductors of the cables 400. Thus, a plurality of cables 400 is handled as one unit.

Referring to FIGS. 1 to 3, the first connector 100 includes a plurality of signal contacts (first contacts) 110, a first housing 120 configured to hold the signal contacts 110, and a shell 130 covering part of a base portion 124 of the first housing 120. The first housing 120 is formed of an insulating material. The signal contacts 110 and the shell 130 of the present embodiment are incorporated into and/or attached to the first housing 120 along with formation of the first housing 120 by a mold-in-place method.

Referring to FIGS. 1 to 3, each of the signal contacts 110 has a contact portion (first contact portion) 112 and a fixing portion 114 fixed to the circuit board 300 by solder. Each of the signal contacts 110 is held on the first housing 120 so that the first contact portion 112 and the fixing portion 114 are exposed.

As shown in FIG. 1, the base portion 124 of the first housing 120 generally extends along the X-direction and holds the plurality of signal contacts 110 in a manner such that the signal contacts 110 are arranged in the X-direction. Side portions 122 are provided on opposite ends of the base portion 124 in the X-direction. Each of the side portions 122 includes a front wall (pressure application portion) 122-1, a side wall 122-2, and a rear wall 122-3. A recess surrounded by the front wall 122-1, the side wall 122-2, and the rear wall 122-3 serves as an end receiver 122-4. Ends of the second connector 200 in the X-direction are received in the end receivers 122-4 as described later. The end receivers 122-4 are designed so as to be slightly larger in size than the ends of the second connector 200 in the X-direction (portions to be received in the end receivers 122-4). Therefore, the front walls 122-1 regulate movement of the ends of the second connector 200 in the X-direction along the Y-direction (second direction) so as to position the second connector 200 in the Y-direction when the ends of the second connector 200 in the X-direction (third direction) are received into the end receivers 122-4. Specifically, the end receivers 122-4, the front walls 122-1 in particular, serve as first positional regulators operable to regulate the position of the second connector 200 in the Y-direction. Furthermore, the two side walls 122-2 sandwich the ends of the second connector 200 therebetween in the X-direction for thereby positioning the second connector 200 in the X-direction. Specifically, the two side walls 122-2 of the end receivers 122-4 serve as second positional regulators operable to regulate the position of the second connector 200 in the X-direction. The two types of positional regulators are useful for a mating operation, which will be described later.

Referring to FIGS. 2, 3, and 5, the base portion 124 of the present embodiment includes a support portion 126 provided so as to have a height along the Z-direction (first direction) and an overhanging portion 128 supported by the support portion 126 so as to extend along the Y-direction. As best illustrated in FIG. 5, the support portion 126 of the present embodiment has an L-shaped cross-section on the YZ-plane. The support portion 126 and the overhanging portion 128 form a cranked shape. Specifically, the support portion 126 according to the present embodiment is formed by two parts including a short part having a relatively small height and a tall part having a relatively large height. More specifically, the short part of the support portion 126 is designed so as to be longer in the Y-direction than the tall part. The shell 130 is held on an upper surface of the short part. The shell 130 held on the upper surface of the short part also serves as a first abutment portion 136 that contributes to positioning of the first connector 100 and the second connector 200 in the Z-direction at an initial stage of a mating operation of the first connector 100 and the second connector 200.

Referring to FIG. 5, the overhanging portion 128 has two surfaces 128-1 and 128-2 in the Z-direction. Furthermore, each of the first contact portions 112 of the present embodiment has a U-shaped cross-section on the YZ-plane. The first housing 120 of the present embodiment holds the signal contacts 110 so that the first contact portions 112 are located on the surfaces 128-1 and 128-2 of the overhanging portion 128. Thus, each of the first contact portions 112 is exposed on the upper and lower surfaces of the overhanging portion 128. Therefore, electrical inspection can readily be performed even after the first connector is mounted to the circuit board. Nonetheless, the present invention is not limited to this example. For example, each of the first contact portions 112 may be exposed on only one of the surfaces 128-1 and 128-2 of the overhanging portion 128.

The overhanging portion 128 of the present embodiment extends along the Y-direction from an end of the support portion 126 in the Z-direction. A space is defined between the overhanging portion 128 and the circuit board 300 (i.e., below the overhanging portion 128). This space serves as a receptacle portion 128-3. Part of the receptacle portion 128-3 is illustrated by broken lines. Functions of the receptacle portion 128-3 will be described later.

Referring to FIG. 1, the shell 130 includes shell connection portions 132 located on opposite sides of the array of the first contact portions 112 of the signal contacts 110 and fixing portions 134 projecting from the side portions 122 of the first housing 120. The fixing portions 134 are fixed to the circuit board 300. Referring to FIGS. 2 and 3, each of the shell connection portions 132 has a U-shaped cross-section on the YZ-plane as with the first contact portions 112 of the signal contacts 110. Each of the shell connection portions 132 is exposed on the overhanging portion 128 of the first housing 120.

Referring to FIGS. 1 to 5, the second connector 200 includes signal contacts (second contacts) 210, ground contacts 220, a second housing 230 configured to hold the signal contacts 210 and the ground contacts 220, an upper shell 260, and a lower shell 270. The second housing 230 is formed of an insulating material. The upper shell 260 and the lower shell 270 cover at least part of an upper portion and a lower portion of the second housing 230.

As shown in FIG. 2, each of the signal contacts 210 includes a second contact portion 212 (second contact portion) that contacts the corresponding first contact portion 112 of the first connector 100 in a mating state of the first connector 100 and the second connector 200. Each of the signal contacts 210 also includes a connection portion 214 connected to the corresponding signal conductor 410 of the cable 400. Specifically, each of the cables 400 is attached to the second connector 200 such that it is connected to the connection portion 214 in a state in which the signal conductor 410 projects from the insulator 420 toward the second contact portion 212. With this configuration, the second connector 200 can be reduced in height.

Meanwhile, as shown in FIG. 3, each of the ground contacts 220 includes a contact portion 222 that is brought into contact with the corresponding shell connection portion 132 of the first connector 100 in a mating state of the first connector 100 and the second connector 200.

As is apparent from FIGS. 2 and 3, each of the second contact portions 212 and the contact portions 222 of the present embodiment has a hooked-shape and sandwiches the first contact portion 112 or the shell connection portion 132, which is exposed on the overhanging portion 128 of the first connector 100, in the Z-direction for thereby establishing connection with the first contact portion 112 or the shell connection portion 132 in a mating state of the first connector 100 and the second connector 200. If the first contact portions 112 or the shell connection portions 132 of the first connector 100 are exposed on only one of the surfaces 128-1 and 128-2 of the overhanging portion 128, then each of the second contact portions 212 and the contact portions 222 sandwiches the first contact portion 112 or the shell connection portion 132 and the overhanging portion 128 in the Z-direction.

As shown in FIG. 5, the second housing 230 of the present embodiment includes a temporary receptacle portion 232 capable of temporarily receiving the overhanging portion 128 of the first connector 100 along the Z-direction and a receiver 234 disposed adjacent to the temporary receptacle portion 232 in the Y-direction. The receiver 234 communicates with the temporary receptacle portion 232. Part of the receiver 234 is illustrated by broken lines, which also holds true in the following description. The signal contacts 210 are held on the second housing 230 so that at least part of the second contact portions 212 is exposed to the receiver 234.

Figure 4:
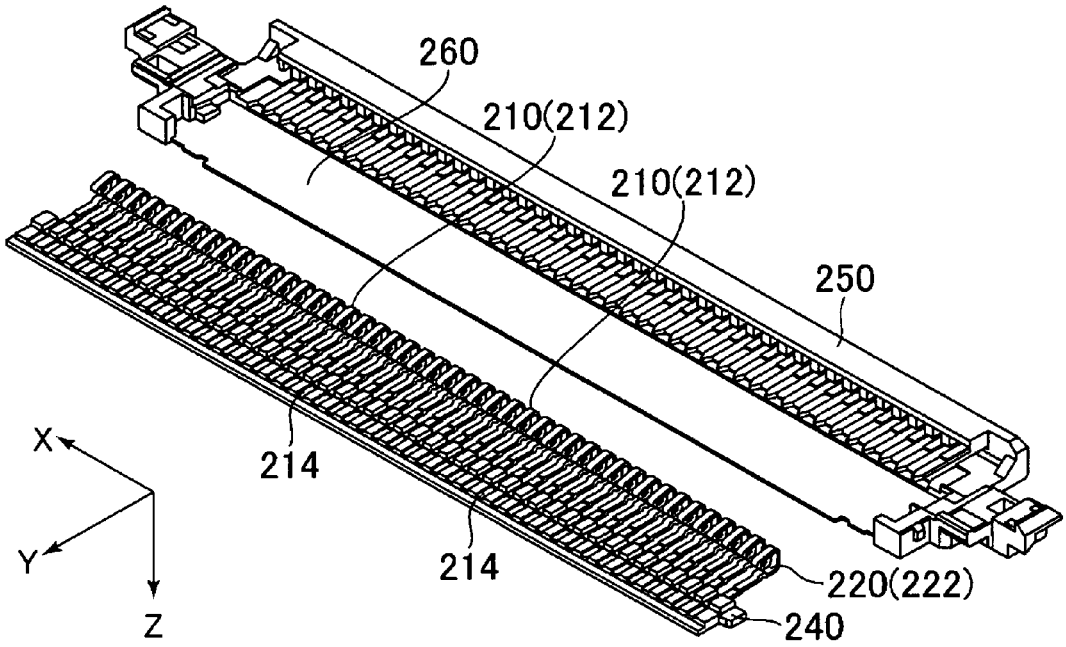
FIG. 4 is an exploded perspective view of the second connector of FIG. 1 as viewed from a bottom of the second connector.

Specifically, as shown in FIGS. 4 and 5, the second housing 230 of the present embodiment includes a locator member 240 configured to hold and align the signal contacts 210 and the ground contacts 220 and a space defining member 250 configured to define the receiver 234. The locator member 240 and the space defining member 250 have insulating characteristics. Specifically, the signal contacts 210 and the ground contacts 220 are aligned by a mold-in-place method when the locator member 240 is formed. In the present embodiment, there are two ground contacts 220. Each of the ground contacts 220 is located outside of the outermost signal contact 210 in the X-direction. Furthermore, the upper shell 260 is attached to the space defining member 250 by a mold-in-place method when the space defining member 250 is formed. The second housing 230 is produced by combining, melting, and integrating the locator member 240 into which the signal contacts 210 and the ground contacts 220 have been incorporated and the space defining member 250 to which the upper shell 260 has been attached. The locator member 240 may be pressed into the space defining member 250 and integrated with the space defining member 250.

On the YZ-plane, as shown FIGS. 2, 3, and 5, the space defining member 250 of the present embodiment includes a base portion 252 extending along the Y-direction, a wall 254 extending along the Z-direction from the base portion 252, and a receivable portion 256 extending along the Y-direction from the wall 254. The receiver 234 is defined by a space surrounded by the base portion 252, the wall 254, and the receivable portion 256. The temporary receptacle portion 232 is defined by a space below the base portion 252 that is adjacent to the receiver 234 in the Y-direction.

More specifically, the wall 254 of the present embodiment extends along the Z-direction from an end of the base portion 252 in the Y-direction. The receivable portion 256 extends along the Y-direction from an end of the wall 254 in the Z-direction. Thus, the base portion 252, the wall 254, and the receivable portion 256 form a hooked-shape cross-section on the YZ-plane. The signal contacts 210 are held on the second housing 230 so that part of the second contact portions 212 projects into the receiver 234, which is defined by the hooked-shape cross-section. Specifically, in the present embodiment, the locator member 240 and the space defining member 250 are combined with each other so that the aforementioned relationship is established between the receiver 234 and the second contact portions 212.

Figure 6:
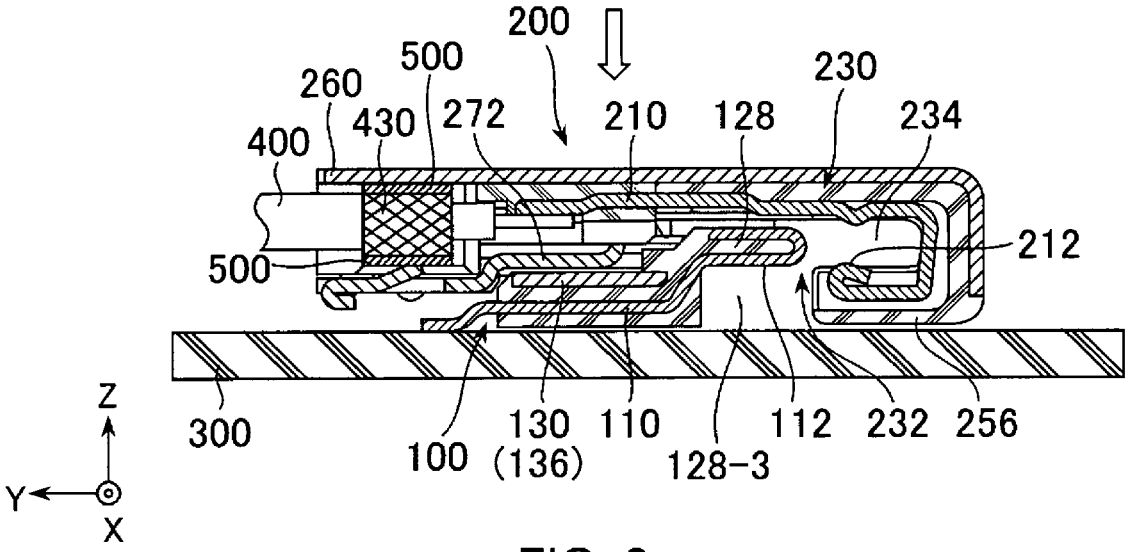
FIG. 6 is cross-sectional view showing another step of the mating operation of the first connector and the second connector shown in FIG. 1, wherein an overhanging portion of the first connector is received in a temporary receptacle portion of the second connector, so that the second connector is positioned with respect to the first connector in the Z-direction (first direction).

As can be seen from FIGS. 5 and 6, part of the lower shell 270 of the present embodiment serves as a second abutment portion 272 that is brought into abutment against the first abutment portion 136 for positioning the second connector 200 in the Z-direction when the second connector 200 is moved relative to the first connector 100 along the Z-direction. Specifically, the second abutment portion 272 and the first abutment portion 136 are configured such that the positions of the second contact portions 212 correspond to the positions of the first contact portions 112 in the Z-direction when the second abutment portion 272 and the first abutment portion 136 are brought into abutment against each other. In other words, the first abutment portion 136 and the second abutment portion 272 serve as positioners operable to position the second contact portions 212 with respect to the first contact portions 112 in the Z-direction when the second connector 200 is moved relative to the first connector 100 along the Z-direction. In the present embodiment, when positioning is carried out by the first abutment portion 136 and the second abutment portion 272, the overhanging portion 128 of the first connector 100 is received into the temporary receptacle portion 232 of the second connector 200.

Figure 7:
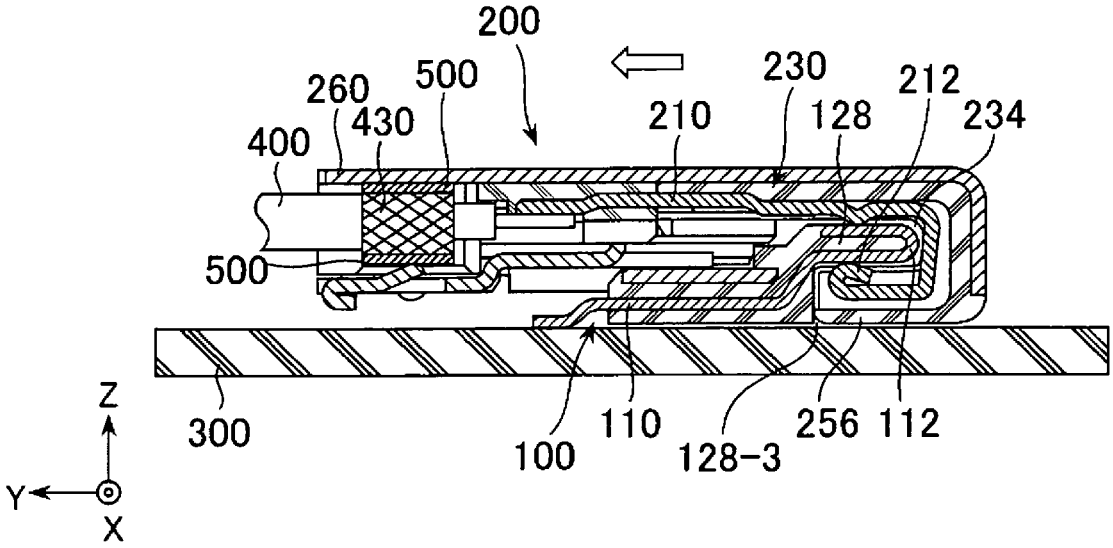
FIG. 7 is a cross-sectional view showing still another step of the mating operation of the first connector and the second connector shown in FIG. 1, wherein the overhanging portion of the first connector is received in a receiver of the second connector so that the second connector is mated with and connected to the first connector.

Furthermore, as shown in FIGS. 5 to 7, the first abutment portion 136 of the present embodiment extends along Y-direction by a predetermined length. Therefore, the first abutment portion 136 can guide the second abutment portion 272 along the Y-direction when the second connector 200 is moved relative to the first connector 100 along the Y-direction in a state in which the first abutment portion 136 abuts the second abutment portion 272 (i.e., in a state in which the second contact portions 212 have been positioned in the Z-direction). This guide function allows the second contact portions 212 to be moved along the Y-direction with maintaining the relative relationship between the second contact portions 212 and the first contact portions 112 in the Z-direction until the second contact portions 212 are brought into contact with the first contact portions 112. Thus, the first abutment portion 136 of the present embodiment also serves as a movement guide operable to guide a relative movement of the second connector 200 relative to the first connector 100 along the Y-direction in a state in which the second contact portions 212 have been positioned in the Z-direction until the second contact portions 212 are brought into contact with the first contact portions 112. In the present embodiment, when the second connector 200 is moved relative to the first connector 100 along the Y-direction, the receivable portion 256 is received into the receptacle portion 128-3 whereas the overhanging portion 128 is received into the receiver 234. This configuration can increase the contact reliability between the first contact portions 112 of the first connector 100 and the second contact portions 212 of the second connector 200.

As described above, the second contact portions 212 are positioned in the Z-direction by the abutment of the second abutment portion 272 against the first abutment portion 136. (The overhanging portion 128 is temporarily received in the temporary receptacle portion 232.) Then the second connector 200 is moved relative to the first connector 100 only along the Y-direction. Therefore, the first contact portions 112 of the first connector 100 and the second contact portions 212 of the second connector 200 can be brought into contact with each other in the receiver 234 and the receptacle portion 128-3, irrespective of the positional relationship between the overhanging portion 128 and the receiver 234 in the Z-direction and the positional relationship between the receivable portion 256 and the receptacle portion 128-3 in the Z-direction. Thus, according to the present embodiment, the first connector 100 and the second connector 200 can readily be mated with each other even if the connector assembly is reduced in height.

The first abutment portion and the second abutment portion are not limited to those illustrated in the present embodiment. Other parts may be used for the first abutment portion and the second abutment portion as long as the second contact portions 212 and the first contact portions 112 are brought into positions at which the second contact portions 212 correspond to the first contact portions 112 in the Z-direction by the abutment of the second abutment portion against the first abutment portion through the movement of the second connector 200 relative to the first connector 100 along the Z-direction. For example, inner bottoms of the end receivers 122-4 formed in the side portions 122 of the first housing 120 may be used as first abutment portions, and the opposite ends of the second connector 200 in the X-direction (portions to be received in the end receivers 122-4) may be used as second abutment portions. In this example, the size, shape, and position, and the like of the first abutment portions and the second abutment portions are determined such that the overhanging portion 128 and the receiver 234 are located at the same level in the Z-direction when the overhanging portion 128 is temporarily received in the temporary receptacle portion 232 and the second abutment portions abut the first abutment portions.

With the first abutment portion and the second abutment portion, the first contact portions 112 and the second contact portions 212 of the present embodiment are held on the first housing 120 and the second housing 220, respectively, such that they are out of contact with each other when the overhanging portion 128 is temporarily received in the temporary receptacle portion 232, but that they are in contact with each other when the overhanging portion 128 has been received in the receiver 234. Therefore, it is possible to minimize unnecessary metal deterioration by friction between the first contacts 110 and the second contacts 210.

In the connector assembly according to the present embodiment, as can be seen from FIGS. 1 and 4, holes extending along the X-direction are formed at opposite ends of the space defining member 250, which constitutes the second housing 230, in the X-direction. Rotatable portions 282 provided at opposite ends of a lock member 280 are rotatably supported in those holes. The lock member 280 is produced by bending a metal rod into a convex shape. The rotatable portions 282 of the lock member 280 are arranged so as to face each other in the X-direction. In the present embodiment, pushers 284 of the lock member 280 are pressed against the front walls (pressure application portions) 122-1 of the side portions 122 by rotating and pushing down the lock member 280 in a mating state of the first connector 100 and the second connector 200 in which the overhanging portion 128 has been received in the receiver 234. Reaction forces produced by the pushers 284 are used to move the second connector 200 relative to the first connector 100, thereby maintaining the mating state of the first connector 100 and the second connector 200. The lock member 280 may be used as an operation member when the second connector 200 is to be separated from the first connector 100.

Figure 8:
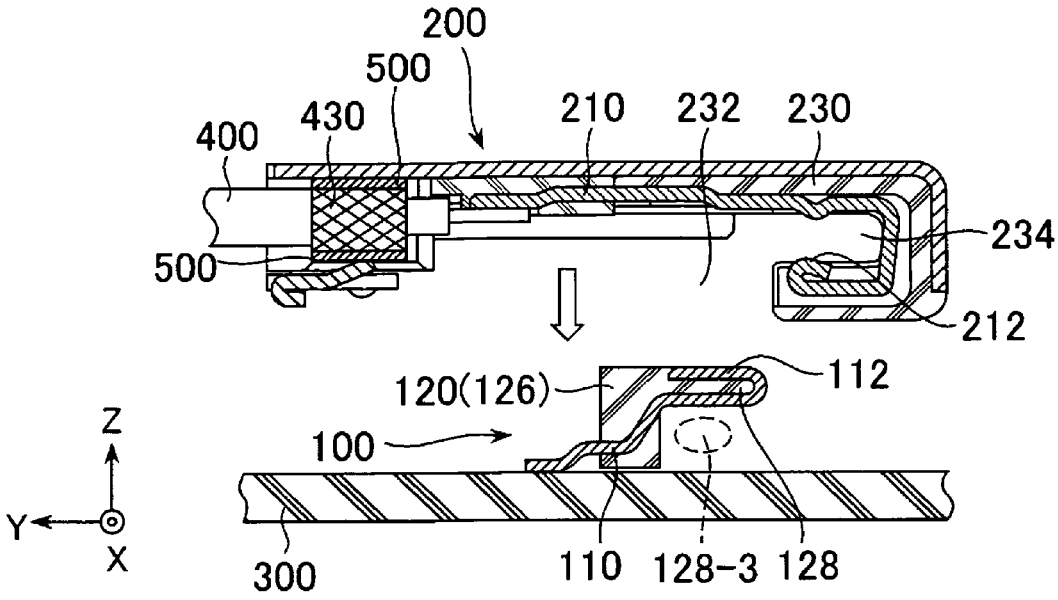
FIG. 8 is a view showing a variation of the connector assembly shown in FIG. 5.

The present invention has been described with the specific embodiment. However, the present invention is not limited to the aforementioned embodiment. For example, the support portion 126 for supporting the overhanging portion 128 has an L-shaped cross-section on the YZ-plane in the above embodiment. Nevertheless, the support portion 126 may have a rectangular cross-section as shown in FIG. 8 or may have another cross-section.

Figure 9:
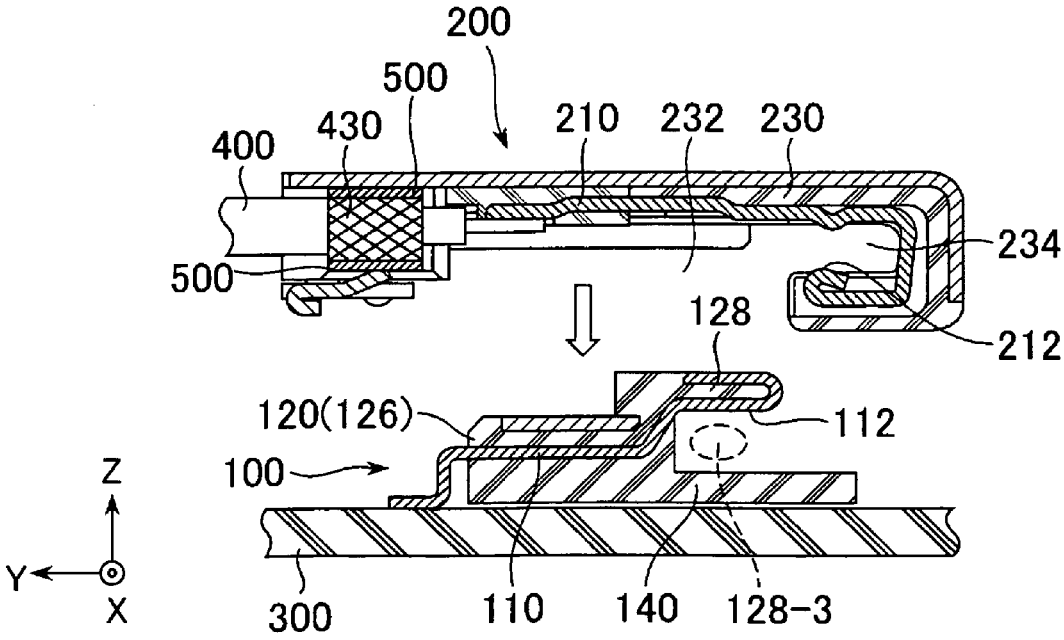
FIG. 9 is a view showing another variation of the connector assembly shown in FIG. 5.

Furthermore, the overhanging portion 128 of the above embodiment faces the circuit board 300 in the Z-direction. For example, as shown in FIG. 9, the first housing 120 may have a plate 140 extending along the Y-direction on the YZ-plane. The support portion 126 may support the overhanging portion 128 in a state such that the plate 140 and the overhanging portion 128 are spaced from each other in the Z-direction. In this case, a receptacle portion 128-3 is formed between the plate 140 and the overhanging portion 128.

In the above embodiment, after the overhanging portion 128 is temporarily received in the temporary receptacle portion 232, the second connector 200 is pulled toward the cables 400 and moved relative to the first connector 100 along the Y-direction in order to move the overhanging portion 128 into the receiver 234. However, the present invention is not limited to that example. For example, in order to receive the overhanging portion into the receiver, the positions and directions of the overhanging portions and the receivers may be changed so as to push the second connector toward a direction in which the cables extend.

Figure 10:
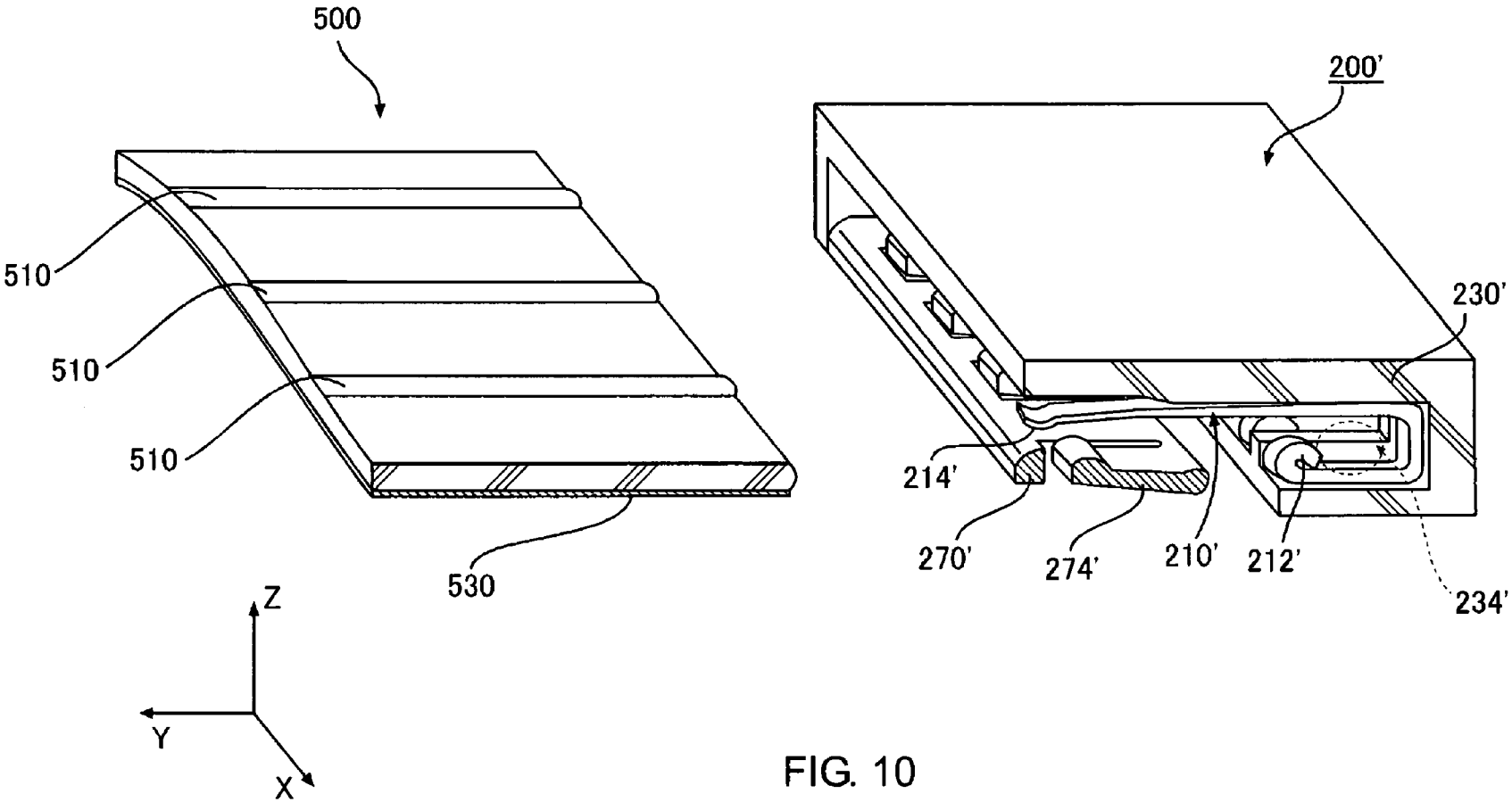
FIG. 10 is a view showing a variation of the second connector shown in FIG. 5.

In the above embodiment, the cables 400 connected to the second connector 200 are coaxial thin wires. The present invention is not limited to that example. For example, as shown in FIG. 10, a second connector 200' may be connected to an FFC or FPC 500. The illustrated FFC or FPC 500 has signal conductors 510 spaced on an upper surface thereof at predetermined intervals and a ground conductor 530 formed on a lower face thereof. Furthermore, the second connector 200' has at least second contacts 210', a second housing 230', and a lower shell 270'. The second contacts 210' have substantially the same structure as the aforementioned second contacts 210 except in that each of the second contacts 210' has a connection spring 214' formed at its rear end for connection with the signal conductor 510. Specifically, each of the second contacts 210' has a hooked-shape end, and a second contact portion 212' is provided on part of the hooked-shape end. The second housing 230' holds the second contacts 210' and has a receiver 234' as with the aforementioned second housing 230. A lower part of the second housing 230' is partially covered with the lower shell 270'. Connection springs 274' to be connected to the ground conductor 530 of the FFC or FPC 500 are formed on the lower shell 270'. With this structure, when the FFC or FPC 500 is inserted from the rear end of the second connector 200, the FFC or FPC 500 is held between the connection springs 214' and the connection springs 274'. Thus, the FFC or FPC 500 is held by the second connector 200'. At that time, the connection springs 214' and the connection springs 274' are respectively connected to the signal conductors 510 and the ground conductor 530 of the FFC or FPC 500.

In the above embodiment, the first connector 100 is mounted and fixed on the circuit board 300, and the cables 400 are connected to the second connector 200. However, the present invention is not limited to that example. For example, both of the first connector 100 and the second connector 200 may be mounted and fixed on circuit boards so as to form a connector assembly for connection between the circuit boards.

Second Embodiment

Figure 11:
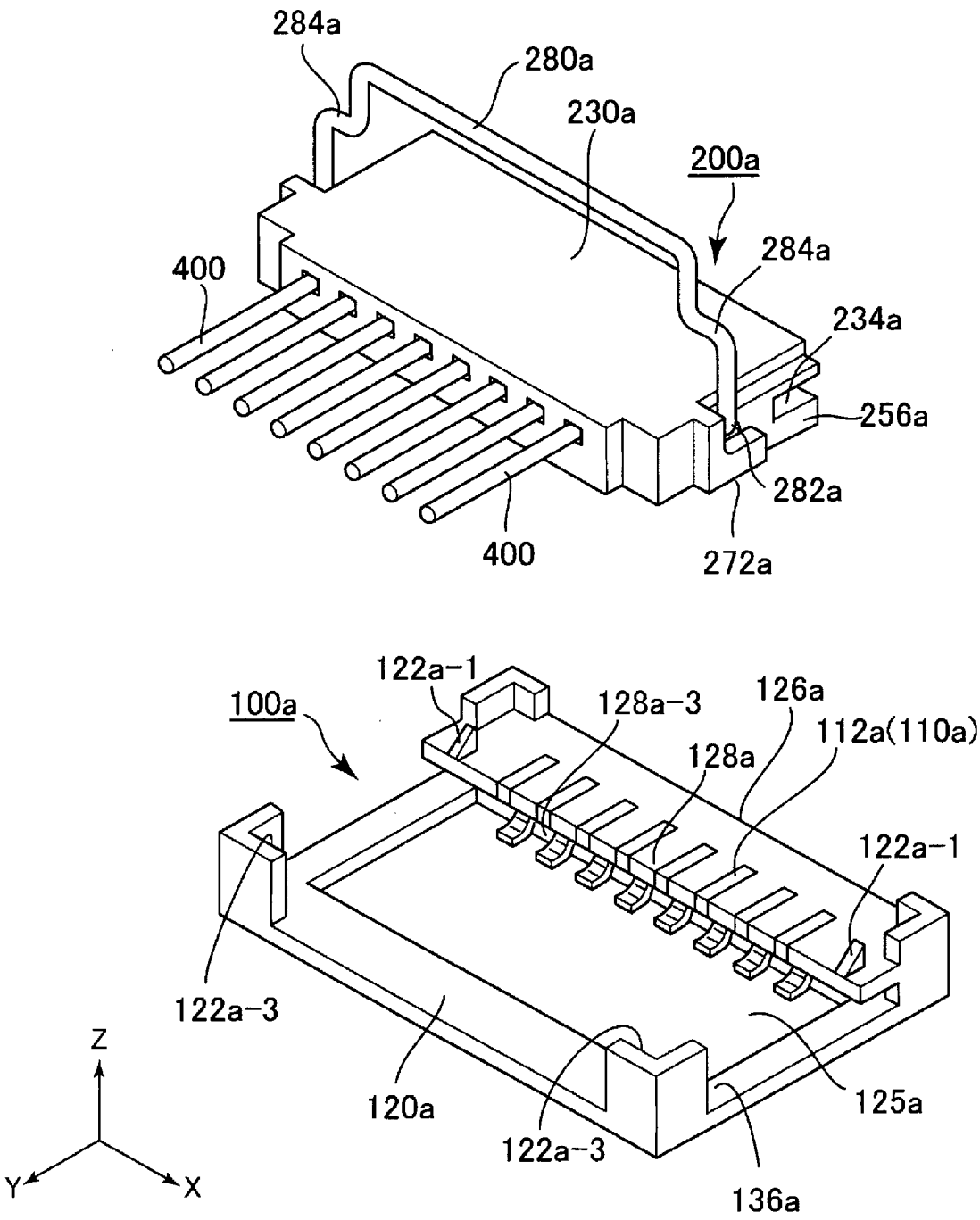
FIG. 11 is a perspective view showing a connector assembly according to a second embodiment of the present invention wherein a first connector and a second connector are separated from each other.
Figure 12:
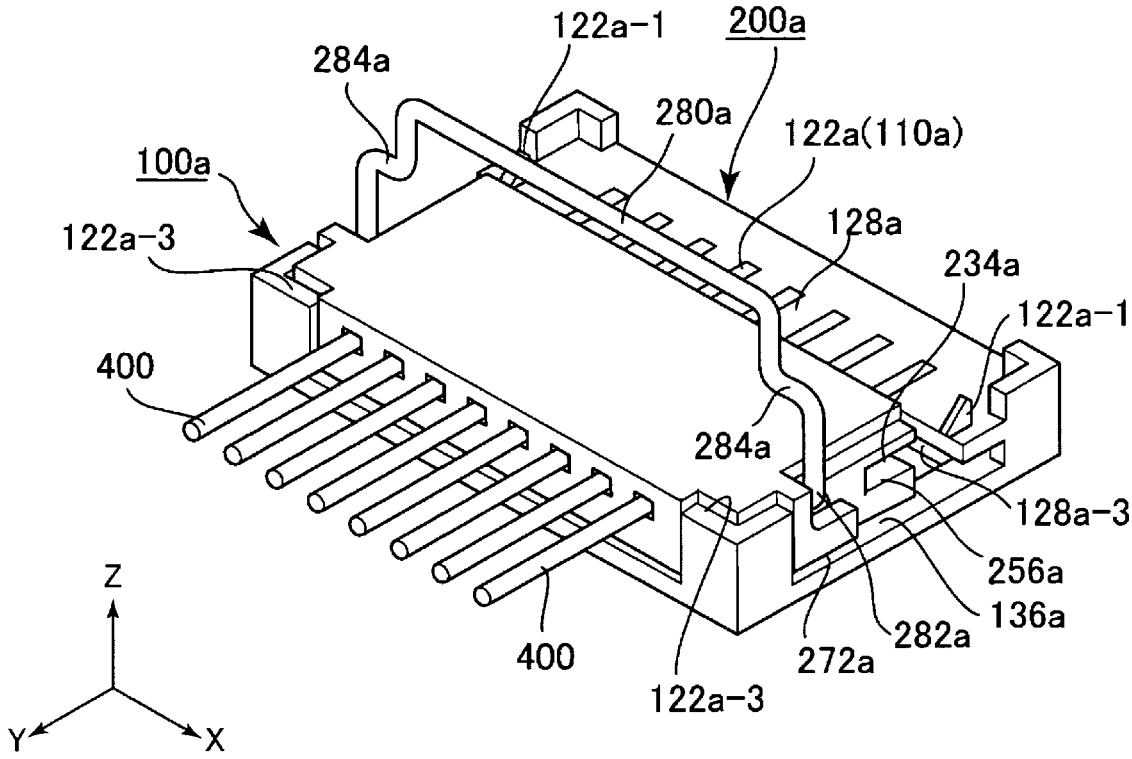
FIG. 12 is a perspective view showing the connector assembly of FIG. 11, wherein the second connector is positioned with respect to the first connector in the Z-direction but is not mated with the first connector.
Figure 13:
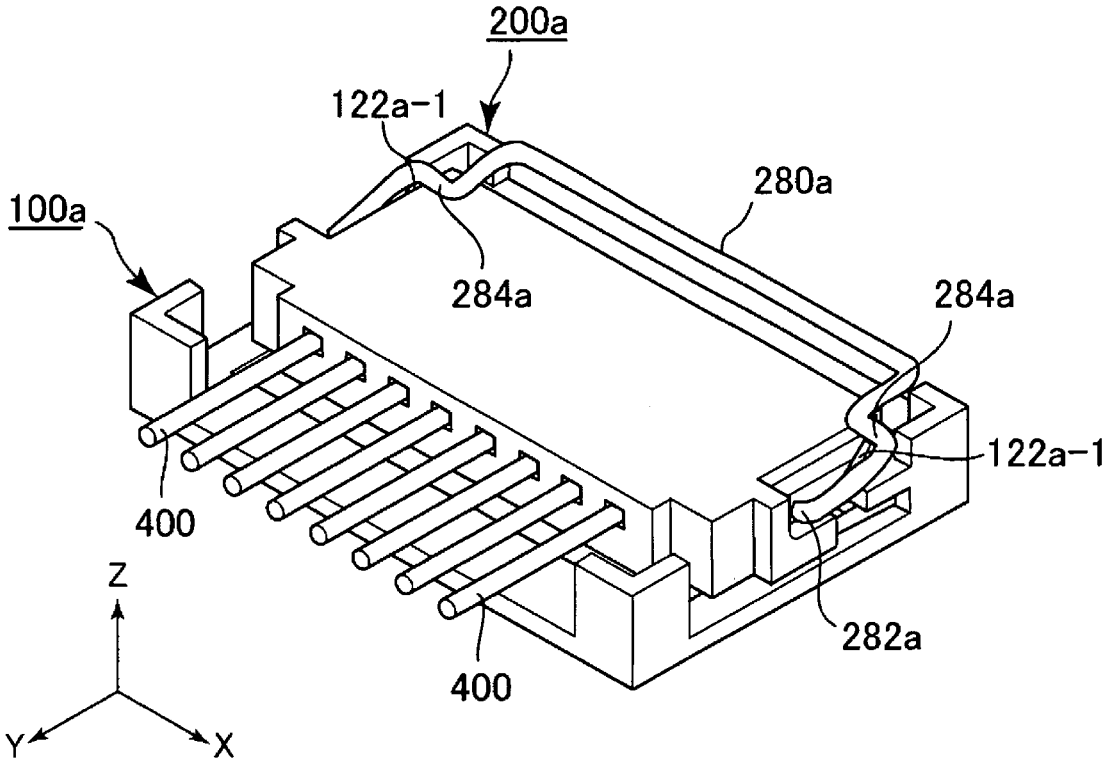
FIG. 13 is a perspective view showing the connector assembly of FIG. 11 wherein the first connector and the second connector are mated with each other.

A connector assembly according to a second embodiment of the present invention will be described in detail below with reference to FIGS. 11 to 13. In the aforementioned first embodiment, the second connector 200 is mated with the first connector 100 by moving the second connector 200 toward the direction (the positive Y-direction) in which the cables 400 extend from the second connector 200 after positioning the second connector 200 with respect to the first connector 100 in the Z-direction. Referring to the FIGS. 11 to 13, in the second embodiment of the present invention, the second connector **200*a* is mated with the first connector 100*a* by moving the second connector 200*a* toward a direction (the negative Y-direction) opposite to the direction (the positive Y-direction) in which the cables 400 extend from the second connector 200*a* after positioning the second connector 200*a* with respect to the first connector 100*a* in the Z-direction. In FIGS. 11 to 13**, the same parts as in the first embodiment are denoted by the corresponding reference numerals for the sake of brevity.

As shown in FIG. 11, the first connector **100*a* of the present embodiment is formed like a frame as viewed along the Z-direction. The first connector 100*a* includes a first housing 120*a* having insulating characteristics and first contacts 110*a* held on the first housing 120*a***.

The first housing **120*a* has an opening 125*a* formed therein. The first housing 120*a* has a rear wall 122*a*-3, which serves as a positional regulator (first positional regulator) operable to regulate the position of the second connector 200*a* in the Y-direction when the second connector 200*a* is moved relative to the first connector 100*a* along the Z-direction. Side portions of the first housing 120*a* in the form of a frame serve as abutment portions 136*a* that is brought into abutment against part of the second connector 200*a* as described later. The first housing 120*a* has a front wall, which serves as a support portion 126*a* for supporting an overhanging portion 128*a* extending along the Y-direction. Thus, a receptacle portion 128*a*-3 is formed below the overhanging portion 128*a*. Engagement portions 122*a*-1 projecting in the Z-direction are formed near opposite ends of the overhanging portion 128*a* in the X-direction. Furthermore, first contact portions 112*a* of the first contacts 110*a* are exposed on a surface of the overhanging portion 128*a*. Within the opening 125*a* of the first housing 120*a*, the first contacts 110*a* are connected to a wiring pattern on a circuit board on which the first connector 100*a*** is mounted.

The second connector **200*a* of the present embodiment includes a second housing 230*a* having insulating characteristics, second contacts (not shown) held on the second housing 230*a*, and a lock member 280*a* rotatably supported on the second housing 230*a*. The cables 400 are held by the second housing 230*a* so that they extend rearward (along the Y-direction) from a rear end of the second housing 230*a*. For example, each of the second contacts (not shown) is in the form of a tuning fork. Rear ends of the second contacts are connected to the cables 400**. Second contact portions (not shown) are provided near front ends of the second contacts (not shown), which are in the form of a tuning fork.

The second housing **230*a* has a front end having a hooked-shape as viewed along the X-direction. A lower portion of the hooked-shape serves as a receivable portion 256*a* that is received in the receptacle portion 128*a*-3 of the first housing 120*a* in a mating state of the first connector 100*a* and the second connector 200*a*. Specifically, the receivable portion 256*a* of the present embodiment extends frontward (toward the negative Y-direction). Furthermore, a space above the receivable portion 256*a* serves as a receiver 234*a* for receiving the overhanging portion 128*a* in the mating state of the first connector 100*a* and the second connector 200*a***.

Moreover, second abutment portions **272*a* are formed at opposite ends (side portions) of the second housing 230*a* in the X-direction. Those second abutment portions 272*a* are brought into abutment against the first abutment portions 136*a* of the first housing 120*a* when the second connector 200*a* is moved toward the first connector 100*a* along the Z-direction. This abutment allows the first contact portions 112*a* of the first connector 100*a* to correspond to the second contact portions (not shown) of the second connector 200*a*. Specifically, the first abutment portions 136*a* and the second abutment portions 272*a* serve as positioners operable to position the second contact portions (not shown) when the second connector 200*a* is moved toward the first connector 100*a* along the Z-direction. Furthermore, as can be seen from FIGS. 12 and 13, the second abutment portions 272*a* are slid on the first abutment portions 136*a* when the second connector 200*a* is moved relative to the first connector 100*a* toward the negative Y-direction after the first abutment portions 136*a* have abutted the second abutment portions 272*a*. Specifically, the first abutment portions 136*a* serve as movement guides operable to guide the relative movement of the second connector 200***a* relative to the first connector 100*a* along the Y-direction.

The lock member 280*a* of the present embodiment is produced by bending a metal rod. As shown in FIG. 11, the lock member 280*a* includes rotatable shafts 282*a* rotatably supported by the second housing 230*a* and engaging portions 284*a* spaced from the rotatable shafts 282*a* by a predetermined distance. Those engaging portions 284*a* are brought into engagement with the engagement portions 122*a*-1 of the first connector 100*a* by rotational operation of the lock member 280*a* in a mating state of the first connector 100*a* and the second connector 200*a*. The engagement of the engaging portions 284*a* locks the mating state of the first connector 100*a* and the second connector 200*a*.

A protrusion (not shown) projecting downward (toward the negative Z-direction) is formed on a bottom of the second housing 230*a*. The protrusion (not shown) is located between inner walls of the first abutment portions 136*a* when the second abutment portions 272*a* abut the first abutment portions 136*a*. Therefore, the protrusion (not shown) and the inner walls of the first abutment portions 136*a* serve as positional regulators (second positional regulators) operable to regulate the position of the second connector 200*a* in the X-direction when the second abutment portions 272*a* abut the first abutment portions 136*a*.

The second connector 200*a* is moved from the state shown in FIG. 11 toward the first connector 100*a* along the Z-direction. Thus, the second abutment portions 272*a* are brought into abutment against the first abutment portions 136*a*. That state is illustrated in FIG. 12. Then the second abutment portions 272*a* are slid on the first abutment portions 136*a* so as to move the second connector 200*a* relative to the first connector 100*a* toward the negative Y-direction. Thus, the second connector 200*a* is mated with the first connector 100*a*, and the first contact portions 112*a* are brought into contact with the second contact portions (not shown). Thereafter, the lock member 280*a* is rotated to engage the engaging portions 284*a* with the engagement portions 122*a*-1. Thus, the mating state is locked as shown in FIG. 13. At that time, the overhanging portion 128*a* is received in the receiver 234*a*, and the receivable portion 256*a* is received in the receptacle portion 128*a*-3.

Third Embodiment

Figure 14:
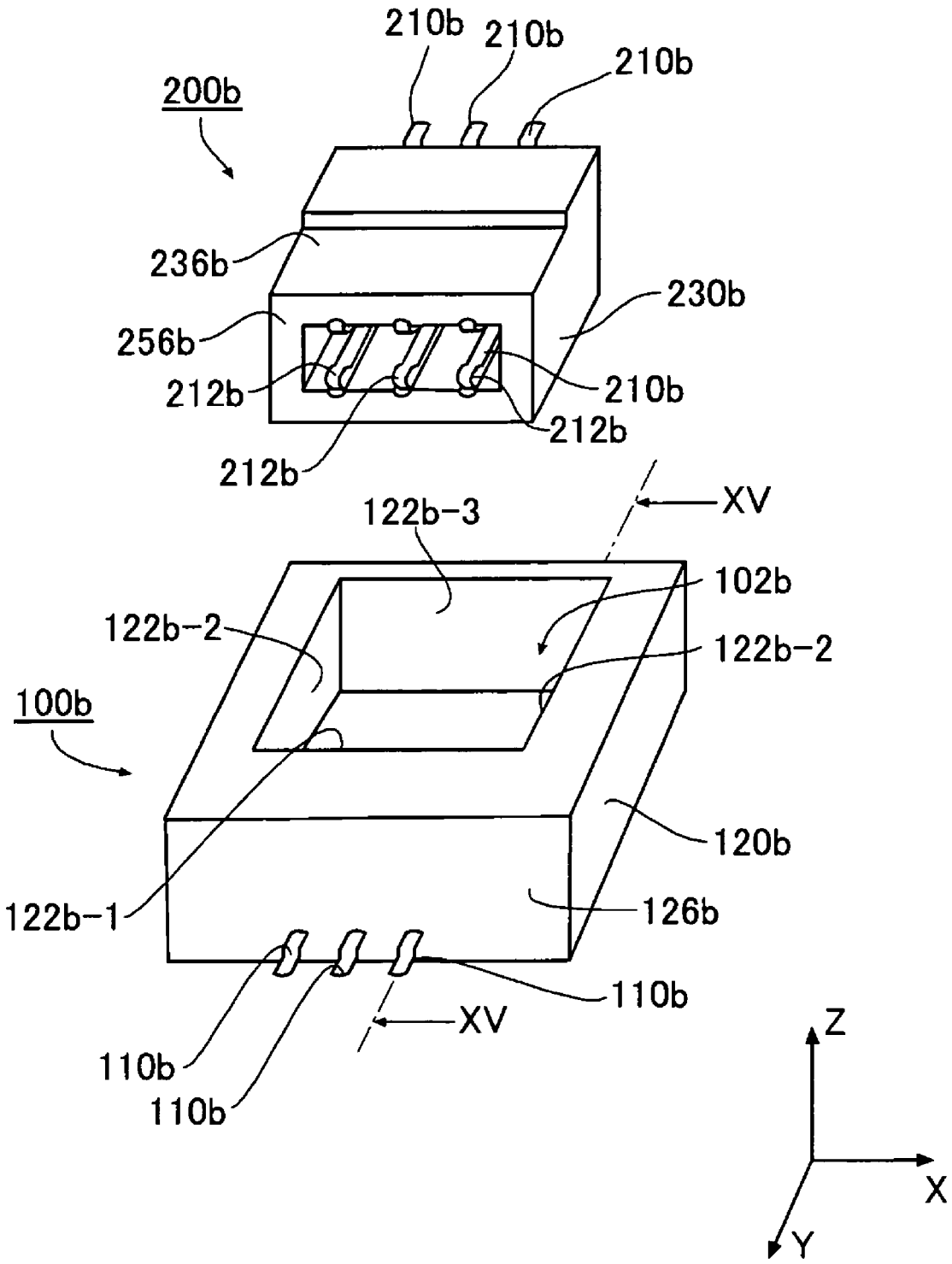
FIG. 14 is a perspective view showing a connector assembly according to a third embodiment of the present invention wherein a first connector and a second connector are separated from each other.
Figure 15:
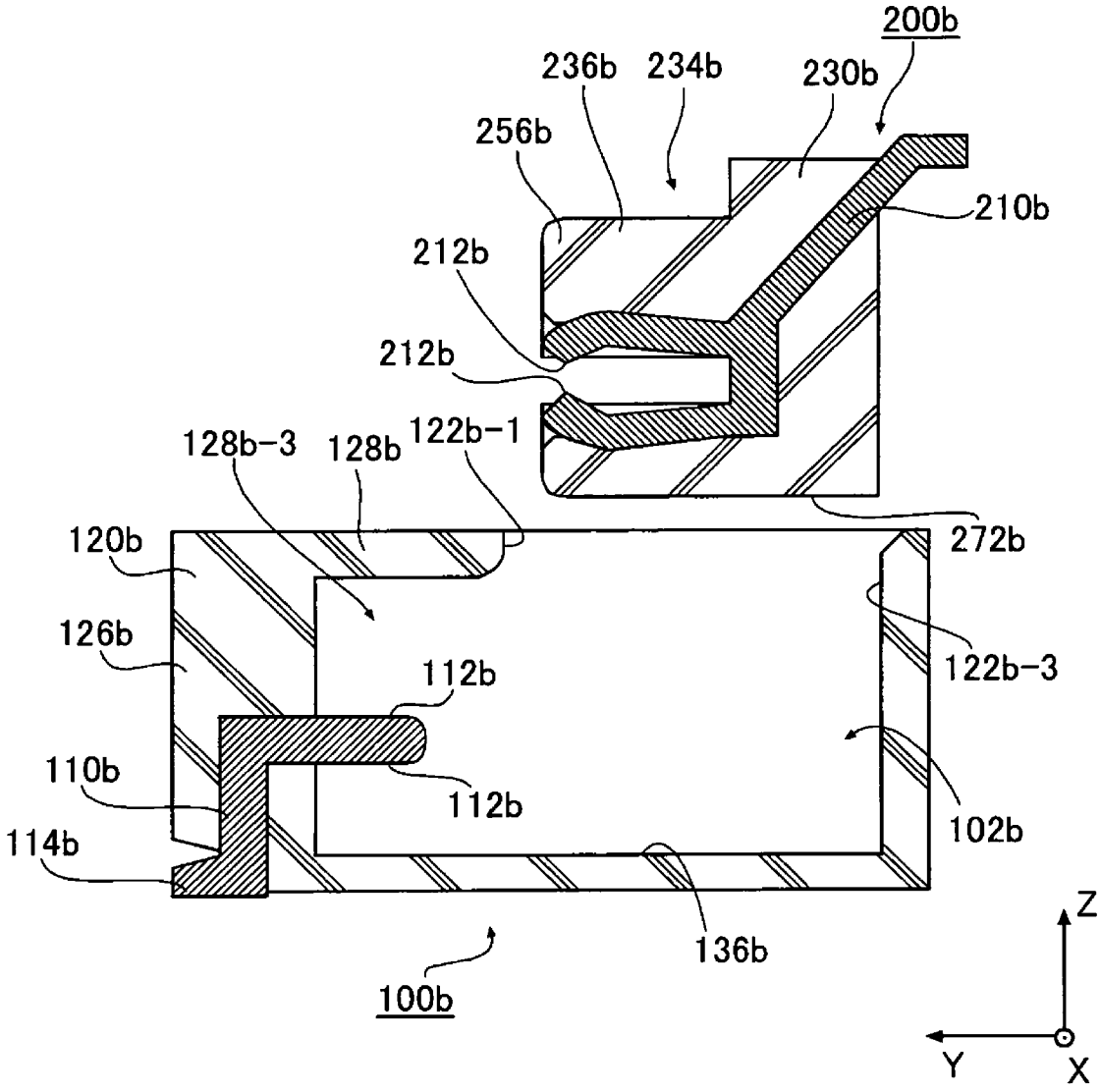
FIG. 15 is a cross-sectional view showing the connector assembly taken along line XV-XV of FIG. 14.

As shown in FIGS. 14 and 15, a connector assembly according to a third embodiment of the present invention includes a first connector 100*b* in the form of a box having a cavity 102*b* defined therein and a second connector 200*b* that is receivable in the cavity 102*b* and matable with the first connector 100*b*.

Referring to FIGS. 14 and 15, the first connector 100*b* includes first contacts 110*b* and a first housing 120*b* configured to hold the first contacts 110*b*. Each contact 110*b* has a first contact portion 112*b* and a fixing portion 114*b*. The first housing 120*b* has insulating characteristics.

The first housing 120*b* has the cavity 102*b* defined therein. The first housing 120*b* includes a thick front wall as a support portion 126*b*, an overhanging portion 128*b* supported by the support portion 126*b*, two side walls 122*b*-2, a rear wall 122*b*-3, and a bottom as a first abutment portion 136*b*. A receptacle portion 128*b*-3 is formed below the overhanging portion 128*b*, i.e., in an area that faces both of the overhanging portion 128*b* and the support portion 126*b*. The first contacts 110*b* are supported on the support portion 126*b* so that the first contact portions 112*b* extend within the receptacle portion 128*b*-3. The overhanging portion 128*b* has an end 122*b*-1 opposed to the rear wall 122*b*-3 in the Y-direction. The end 122*b*-1 of the overhanging portion 128*b* serves as a positional regulator (first positional regulator) operable to regulate the position of the second connector 200*b* in the Y-direction when the second connector 200*b* is received into the cavity 102*b*. The two side walls 122*b*-2 are opposed to each other in the X-direction. The side walls 122*b*-2 serve as positional regulators (second positional regulators) operable to regulate the position of the second connector 200*b* in the X-direction when the second connector 200*b* is received into the cavity 102*b*.

Referring to FIGS. 14 and 15, the second connector 200*b* includes second contacts 210*b* each having a second contact portion 212*b* and a second housing 230*b* configured to hold the second contacts 210*b*. The second housing 230*b* has insulating characteristics.

The second housing 230*b* includes a receivable portion 256*b*, which is received in the receptacle portion 128*b*-3. As can be seen from FIG. 15, the receivable portion 256*b* has a step-down portion 236*b* formed on an upper surface thereof. The step-down portion 236*b* and an upper portion of the second housing 230*b* form a receiver 234*b*. The second housing 230*b* has a bottom, which serves as a second abutment portion 272*b* that is brought into abutment against the first abutment portion 136*b* when the second connector 200*b* is received into the cavity 102*b*. The first housing 120*b* and the second housing 230*b* are arranged such that the positions of the second contact portions 212*b* correspond to the positions of the first contact portions 112*b* in the Z-direction when the second abutment portion 272*b* abuts the first abutment portion 136*b*.

The first abutment portion 136*b* and the second abutment portion 272*b* serve as positioners operable to position the second contact portions 212*b* when the second connector 200*b* is moved toward the first connector 100*b* along the Z-direction. Furthermore, as described later with reference to FIGS. 16 and 17, the second abutment portion 272*b* is slid on the first abutment portion 136*b* when the second connector 200*b* is moved relative to the first connector 100*b* along the Y-direction after the first abutment portion 136*b* has abutted the second abutment portion 272*b*. Specifically, the first abutment portion 136*b* also serves as a movement guide operable to guide the relative movement of the second connector 200*b* relative to the first connector 100*b* along the Y-direction.

Figure 16:
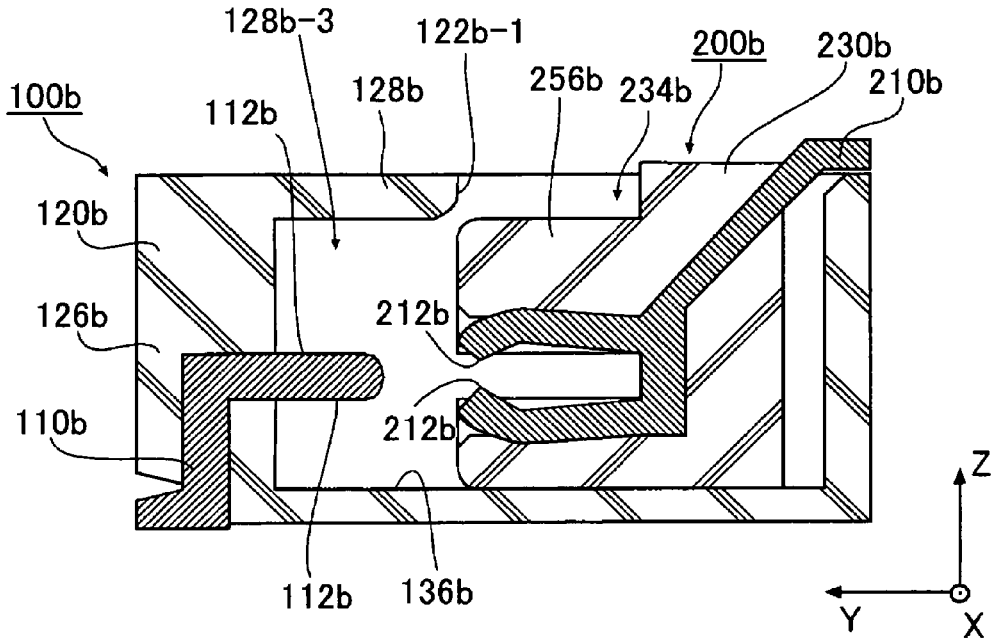
FIG. 16 is a cross-sectional view showing the connector assembly of FIG. 15, wherein the second connector is positioned with respect to the first connector in the Z-direction but is not mated with the first connector.
Figure 17:
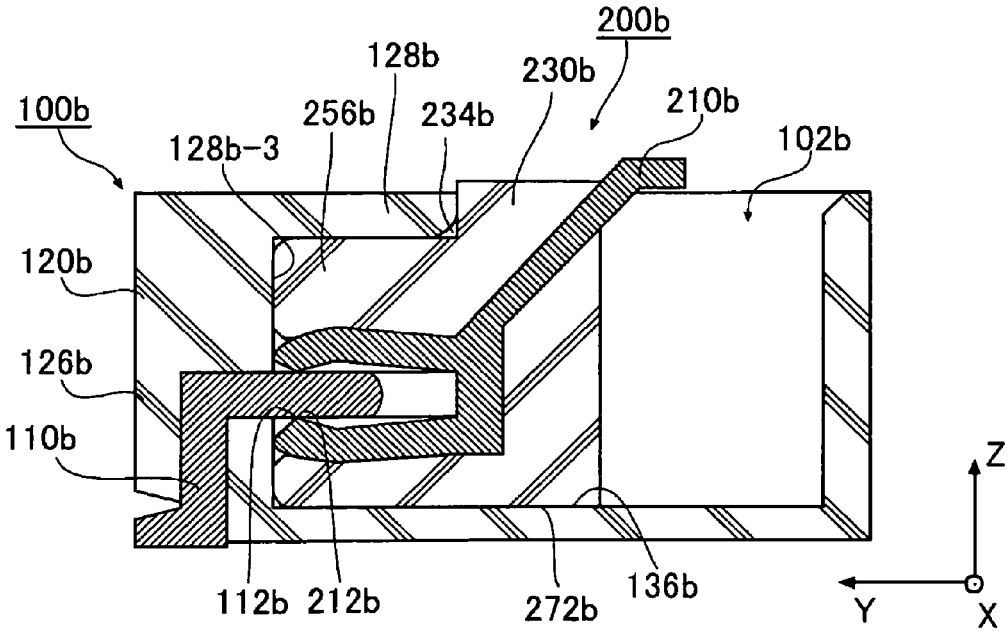
FIG. 17 is a cross-sectional view showing the connector assembly of FIG. 15 wherein the first connector and the second connector are mated with each other.

The second connector 200*b* is moved from the state shown in FIG. 15 toward the first connector 100*b* along the Z-direction. Thus, the second abutment portion 272*b* is brought into abutment against the first abutment portion 136*b*. That state is illustrated in FIG. 16. Then the second abutment portion 272*b* is slid on the first abutment portion 136*b* so as to move the second connector 200*b* relative to the first connector 100*b* along the Y-direction. Thus, as shown in FIG. 17, the first contact portions 112*b* are brought into contact with the second contact portions 212*b*, and the first connector 100*b* and the second connector 200*b* are mated with each other. At that time, the overhanging portion 128*b* is received in the receiver 234*b*, and the receivable portion 256*b* is received in the receptacle portion 128*b*-3.

The first connector 100*b* of the present embodiment is mounted on a circuit board. The first contacts 110*b* are connected to a wiring pattern of the circuit board. Nevertheless, the present invention is not limited to this example.

Figure 18:
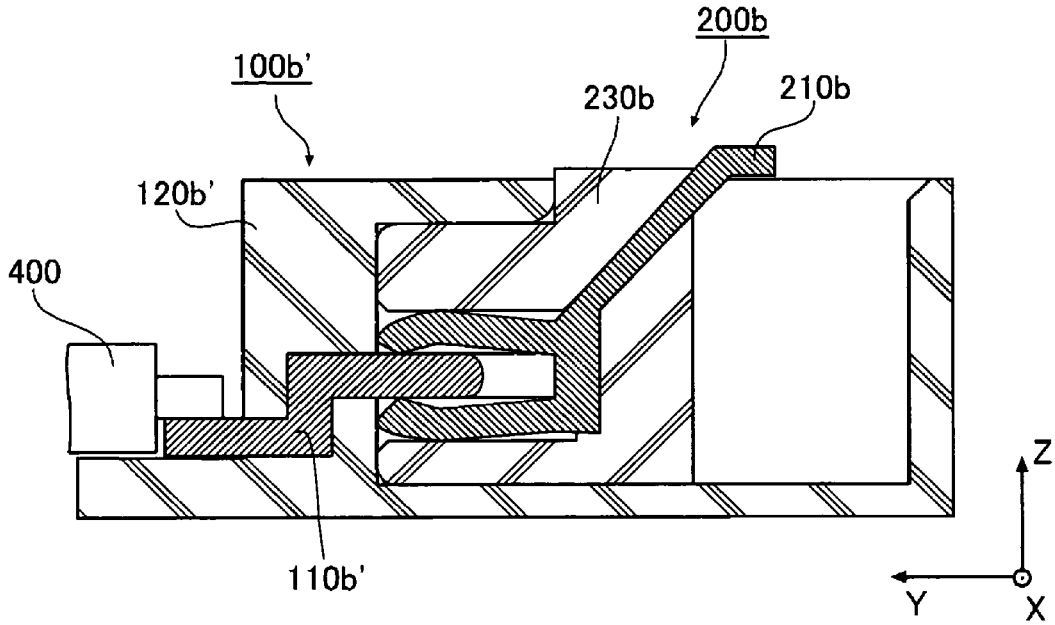
FIG. 18 is a view showing a variation of the connector assembly shown in FIG. 17.

For example, as shown in FIG. 18, the cables 400 may be connected to a first connector 100*b*'. The first connector 100*b*' includes first contacts 110*b*' and a first housing 120*b*' configured to hold the first contacts 110*b*'. Signal conductors of the cables 400 are connected to the first contacts 110*b*'.

Figure 19:
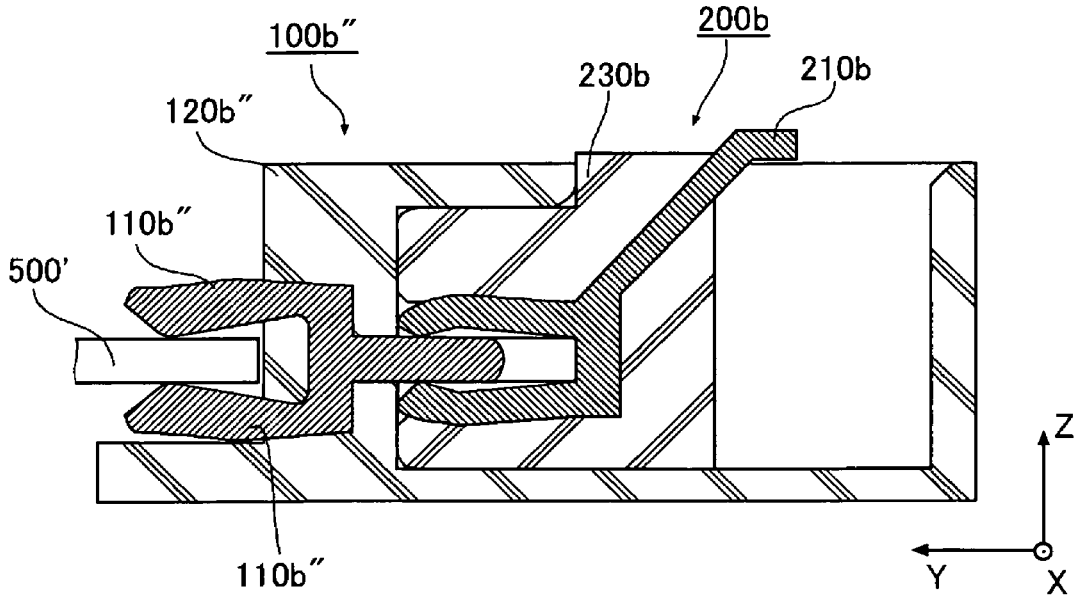
FIG. 19 is a view showing another variation of the connector assembly shown in FIG. 17.

Furthermore, as shown in FIG. 19, an FFC or FPC 500' may be connected to a first connector 100*b*". The FFC or FPC 500' has signal conductors on either one or both of surfaces. The first connector 100*b*" includes first contacts 110*b*" and a first housing 120*b*" configured to hold the first contacts 110*b*". The first contacts 110*b*" are connected to the signal conductors of the FFC or FPC 500'.

Figure 20:
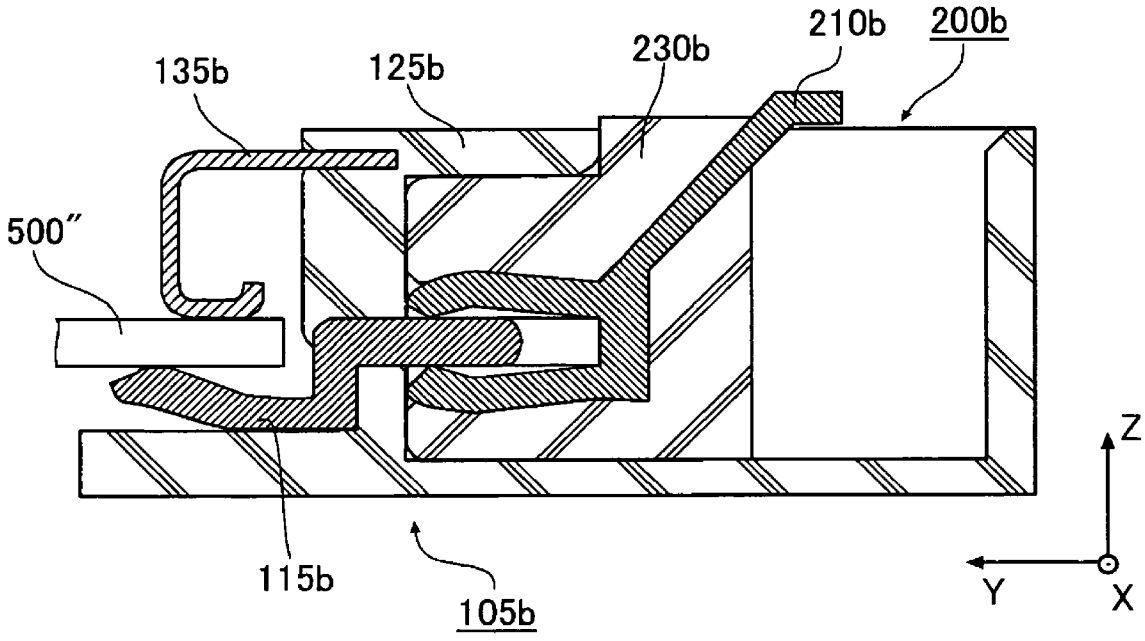
FIG. 20 is a view showing still another variation of the connector assembly shown in FIG. 17.

Moreover, as shown in FIG. 20, an FFC or FPC 500" may be connected to a first connector 105*b*. The FFC or FPC 500" has signal conductors on one surface and ground conductors on the other surface. In the illustrated example, ground conductors are formed on an upper surface of the FFC or FPC 500", whereas signal conductors are formed on a lower surface of the FFC or FPC 500". The first connector 105*b* includes first contacts 115*b*, a first housing 125*b* configured to hold the first contacts 115*b*, and a shell 135*b* partially incorporated in the first housing 125*b*. The first contacts 115*b* are connected to the signal conductors of the FFC or FPC 500", and the shell 135*b* is connected to the ground conductors of the FFC or FPC 500".

Fourth Embodiment

Figure 21:
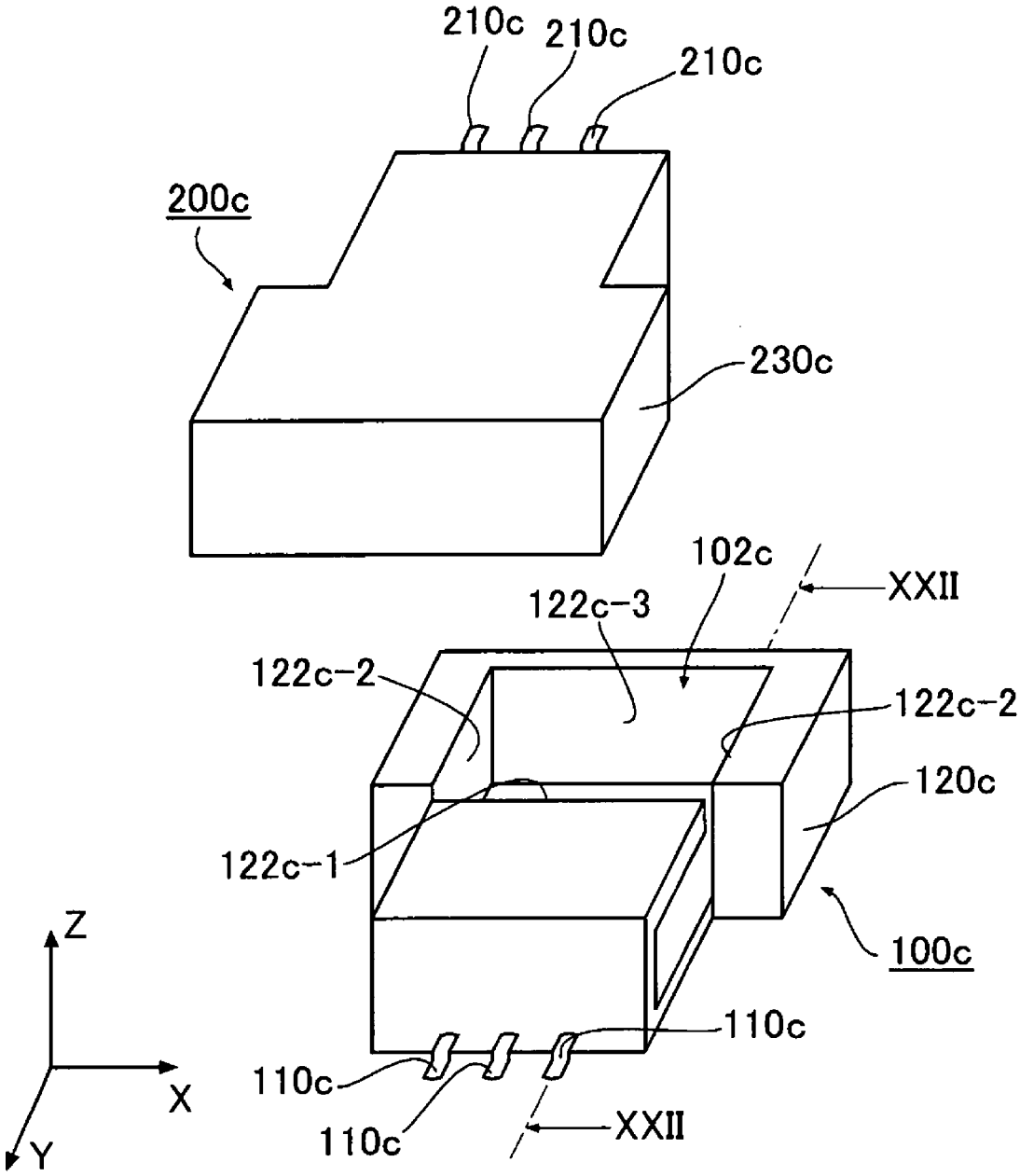
FIG. 21 is a perspective view showing a connector assembly according to a fourth embodiment of the present invention wherein a first connector and a second connector are separated from each other.
Figure 22:
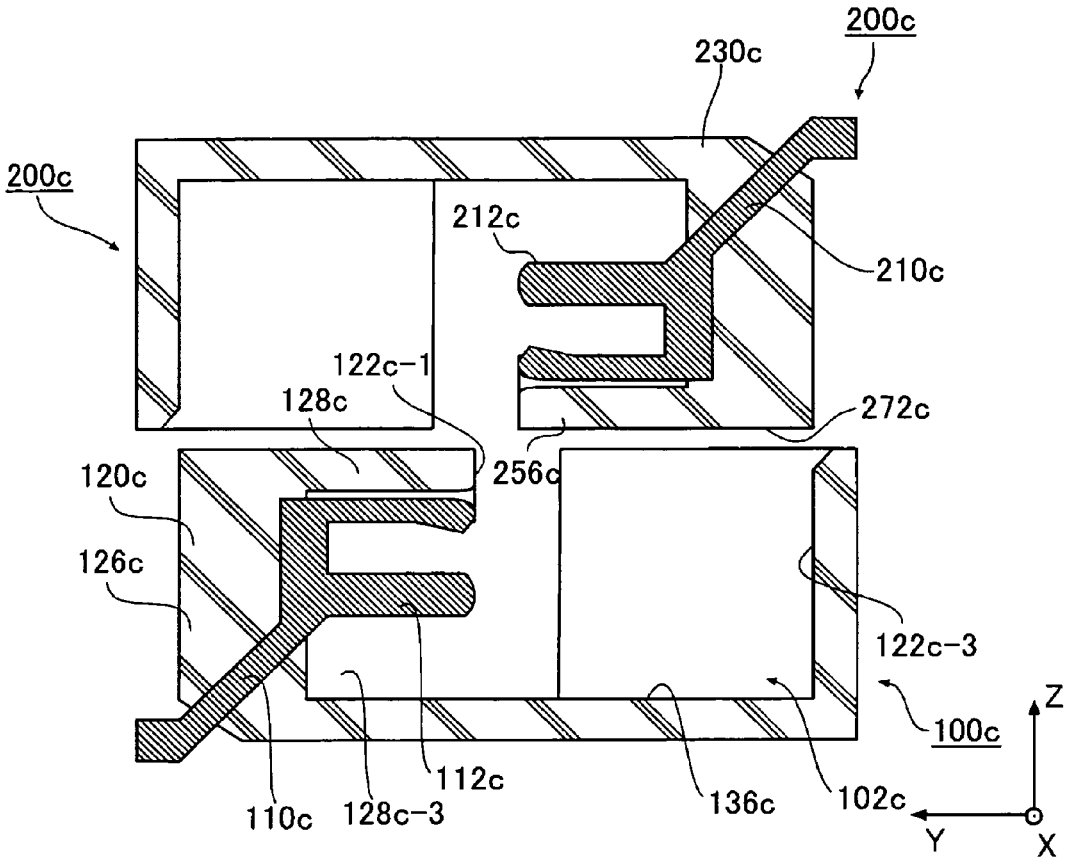
FIG. 22 is a cross-sectional view showing the connector assembly taken along line XXII-XXII of FIG. 21.

As shown in FIGS. 21 and 22, a connector assembly according to a fourth embodiment of the present invention includes a first connector 100*c* and a second connector 200*c*, which have the same structure. The first connector 100*c* has a cavity 102*c* as with the first connector 100*b* of the third embodiment. Specifically, in the structural aspect, the second connector 200*c* also has a cavity. The first connector 100*c* and the second connector 200*c* are mated with each other in a state in which part of the connector is received in the cavity of the other connector. Only distinctive parts for functions of the first connector 100*c* and the second connector 200*c* will be described below.

Referring to FIGS. 21 and 22, the first connector 100*c* includes first contacts 110*c* each having a first contact portion 112*c* and a first housing 120*c* configured to hold the first contacts 110*c*. The first housing 120*c* has insulating characteristics.

The first housing 120*c* has the cavity 102*c* defined therein. The first housing 120*c* includes a thick front wall as a support portion 126*c*, an overhanging portion 128*c* supported by the support portion 126*c*, two side walls 122*c*-2, a rear wall 122*c*-3, and a bottom as a first abutment portion 136*c*. A receptacle portion 128*c*-3 is formed below the overhanging portion 128*c*, i.e., in an area that faces both of the overhanging portion 128*c* and the support portion 126*c*. The first contacts 110*c* are supported on the support portion 126*c* so that the first contact portions 112*c* extend within the receptacle portion 128*c*-3. The overhanging portion 128*c* has an end 122*c*-1 opposed to the rear wall 122*c*-3 in the Y-direction. The end 122*c*-1 of the overhanging portion 128*c* serves a positional regulator (first positional regulator) operable to regulate the position of the second connector 200*c* in the Y-direction when part of the second connector 200*c* (such as a receivable portion 256*c* described later) is received into the cavity 102*c*. The two side walls 122*c*-2 are opposed to each other in the X-direction. The side walls 122*c*-2 serve as positional regulators (second positional regulators) operable to regulate the position of the second connector 200*c* in the X-direction when the second connector 200*c* is received into the cavity 102*c*.

Referring to FIGS. 21 and 22, the second connector 200*c* includes second contacts 210*c* each having a second contact portion 212*c* and a second housing 230*c* configured to hold the second contacts 210*c*. The second housing 230*c* has insulating characteristics.

The second housing 230*c* includes a receivable portion 256*c*, which is received in the receptacle portion 128*c*-3. The receivable portion 256*c* of the second housing 230*c* has a bottom, which serves as a second abutment portion 272*c* that is brought into abutment against the first abutment portion 136*c* when the second connector 200*c* is received into the cavity 102*c*. The first housing 120*c* and the second housing 230*c* are arranged such that the positions of the second contact portions 212*c* correspond to the positions of the first contact portions 112*c* in the Z-direction when the second abutment portion 272*c* abuts the first abutment portion 136*c*.

The first abutment portion 136*c* and the second abutment portion 272*c* serve as positioners operable to position the second contact portions 212*c* when the second connector 200*c* is moved toward the first connector 100*c* along the Z-direction. Furthermore, as described later with reference to FIGS. 23 and 24, the second abutment portion 272*c* is slid on the first abutment portion 136*c* when the second connector 200*c* is moved relative to the first connector 100*c* along the Y-direction after the first abutment portion 136*c* has abutted the second abutment portion 272*c*. Specifically, the first abutment portion 136*c* also serves as a movement guide operable to guide the relative movement of the second connector 200*c* relative to the first connector 100*c* along the Y-direction.

Figure 23:
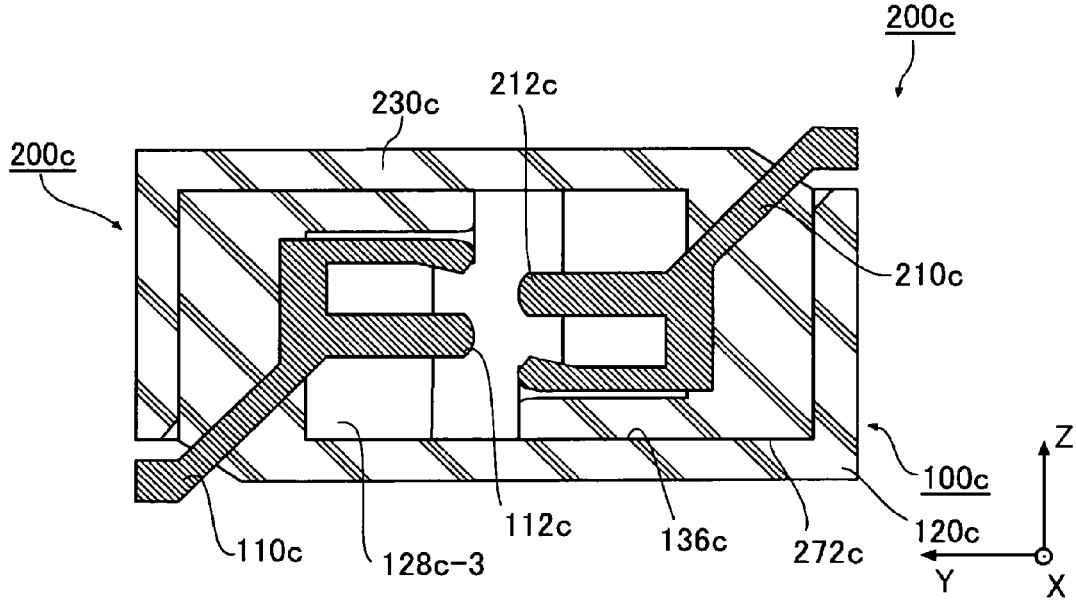
FIG. 23 is a cross-sectional view showing the connector assembly of FIG. 22, wherein the second connector is positioned with respect to the first connector in the Z-direction but is not mated with the first connector.
Figure 24:
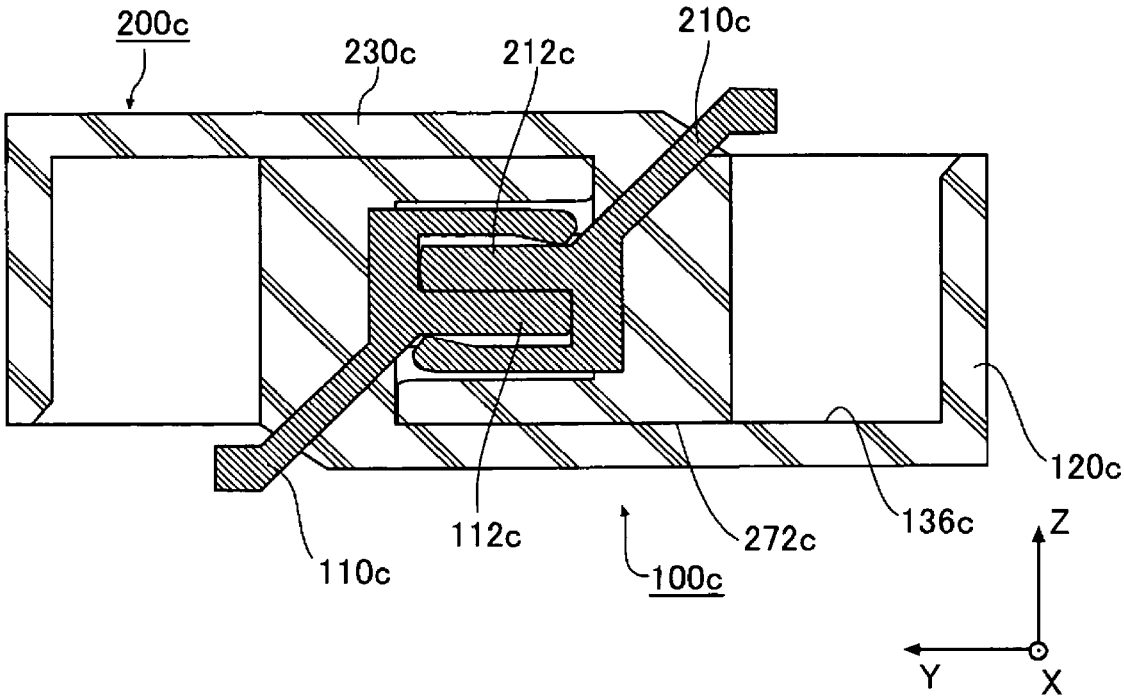
FIG. 24 is a cross-sectional view showing the connector assembly of FIG. 22 wherein the first connector and the second connector are mated with each other.

The second connector 200*c* is moved from the state shown in FIG. 22 toward the first connector 100*c* along the Z-direction. Thus, the second abutment portion 272*c* is brought into abutment against the first abutment portion 136*c*. That state is illustrated in FIG. 23. Then the second abutment portion 272*c* is slid on the first abutment portion 136*c* so as to move the second connector 200*c* relative to the first connector 100*c* along the Y-direction. Thus, as shown in FIG. 24, the first contact portions 112*c* are brought into contact with the second contact portions 212*c*, and the first connector 100*c* and the second connector 200*c* are mated with each other. At that time, the receivable portion 256*c* is received in the receptacle portion 128*c*-3.

The first connector 100*c* and the second connector 200*c* of the present embodiment are mounted on circuit boards. The first contacts 110*c* and the second contacts 210*c* are connected to wiring patterns of the circuit boards. Nevertheless, the present invention is not limited to this example. As with the variation of the third embodiment, either one or both of the first connector 100*c* and the second connector 200*c* may be connected to coaxial cables, an FFC, or an FPC.

A connector assembly according to the present invention has a positioner operable to position in a first direction (vertical direction) and a movement guide operable to guide movement in a second direction (horizontal direction) after the positioning. Therefore, a first contact portion can be brought into contact with a second contact portion by moving the second connector relative to the first connector along first direction (vertical direction) and then moving the second connector relative to the first connector along the second direction (horizontal direction). Thus, according to the present invention, a circuit board is not subjected to any stress, which would be caused in a vertical-connection connector assembly. Furthermore, according to the present invention, since the positioner positions the second contact portion with respect to the first contact portion in the first direction (vertical direction), a subsequent operation only includes moving (sliding) the second connector along the second direction (horizontal direction). In other words, the present invention facilitates the mating operation as compared to a horizontal-connection connector assembly.

The present application is based on a Japanese patent application of JP2009-161276 filed before the Japan Patent Office on Jul. 7, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising:

a first connector including a first contact having a first contact portion and a first housing configured to hold the first contact;

a second connector matable with the first connector, the second connector including a second contact having a second contact portion that is brought into contact with the first contact portion and a second housing configured to hold the second contact;

a positioner operable to position the second contact portion in a first direction so that the second contact portion corresponds to the first contact portion when the second connector is moved relative to the first connector along the first direction; and a movement guide operable to guide a relative movement of the second connector relative to the first connector along a second direction perpendicular to the first direction in a state in which the second contact portion has been positioned in the first direction until the second contact portion is brought into contact with the first contact portion;

wherein the first housing includes a second positional regulator operable to regulate a position of the second connector in a third direction perpendicular to the first direction and the second direction at the time of positioning of the second contact Portion in the first direction.

2. The connector assembly as recited in claim 1, wherein the first contact portion is brought into contact with the second contact portion in the first direction.

3. The connector assembly as recited in claim 1, wherein the first housing includes a first positional regulator operable to regulate a position of the second connector in the second direction at the time of positioning of the second contact portion in the first direction.

4. The connector assembly as recited in claim 1, wherein the first connector has the same structure as the second connector.

5. The connector assembly as recited in claim 1, wherein the first contact portion and the second contact portion are respectively held on the first housing and the second housing such that they are out of contact with each other when the second contact portion has been positioned in the first direction and are brought into contact with each other by the relative movement of the second connector relative to the first connector.

6. The connector assembly as recited in claim 1, wherein the second connector has a lock member including a rotatable shaft rotatably held by the second housing and a pusher provided at a location spaced from the rotatable shaft by a predetermined distance, the first housing includes a pressure application portion against which the pusher is pressed by rotation of the lock member, and the lock member is operable to move the second connector relative to the first connector with a reaction force from the pusher when the pusher is pressed against the pressure application portion.

7. The connector assembly as recited in claim 1, wherein the second connector has a lock member including a rotatable shaft rotatably held by the second housing and an engaging portion provided at a location spaced from the rotatable shaft by a predetermined distance, the first housing includes an engagement portion with which the engaging portion is engaged by rotation of the lock member, and the second connector is locked with respect to the first connector by the engagement of the engaging portion with the engagement portion.

8. A first connector in the connector assembly as recited in claim 1.

9. A second connector in the connector assembly as recited in claim 1.

10. The connector assembly as recited in claim 1, wherein the positioner includes:

a first abutment portion provided on the first connector, and a second abutment portion provided on the second connector, the first abutment portion and the second abutment portion being configured to be brought into abutment against each other by the relative movement of the second connector relative to the first connector in the first direction such that a position of the second contact portion corresponds to a position of the first contact portion in the first direction.

11. The connector assembly as recited in claim 10, wherein the movement guide is formed as part of the first connector, the movement guide includes the first abutment portion and extends along the second direction, and the movement guide is operable to guide the second abutment portion along the second direction in a relative movement of the second connector relative to the first connector in the second direction.

12. The connector assembly as recited in claim 1, wherein the first housing includes an overhanging portion extending along the second direction and a support portion configured to support the overhanging portion, the overhanging portion and the support portion defining a receptacle portion, the second housing includes a receivable portion that can be received in the receptacle portion, and the first contact portion contacts the second contact portion when the receivable portion has been received in the receptacle portion.

13. The connector assembly as recited in claim 12, wherein the first contact is held on the first housing so that the first contact portion is exposed on the overhanging portion, the second contact is held on the second housing so that the second contact portion is exposed on the receivable portion, and the receivable portion is received in the receptacle portion so that the first contact portion and the second contact portion are brought into contact with each other by a relative movement of the second connector relative to the first connector in the second direction.

14. The connector assembly as recited in claim 12, wherein the overhanging portion has two surfaces in the first direction, the first contact portion is exposed on at least one of the two surfaces of the overhanging portion, and the second contact portion has a hook-shape such as to sandwich the first contact portion or the first contact portion and the overhanging portion in the first direction for establishing connection with the first contact portion.

15. The connector assembly as recited in claim 12, wherein a cable having a signal conductor and an insulator covering the signal conductor is attached to the second connector, the second contact further includes a connection portion connected to the signal conductor, and the cable is attached to the second connector so that the signal conductor is connected to the connection portion in a state in which the signal conductor extends from the insulator toward the second contact portion.

16. The connector assembly as recited in claim 12, wherein the second housing includes the receivable portion and a receiver that can receive the overhanging portion, and the overhanging portion is received in the receiver in a state in which the receivable portion has been received in the receptacle portion.

17. The connector assembly as recited in claim 16, wherein the second housing is produced by melting and integrating a locator member configured to hold the second contact and a space defining member configured to define the receiver, the locator member and the space defining member having insulating characteristic.

18. The connector assembly as recited in claim 16, wherein the second housing includes a base portion extending along the second direction and a wall extending along the first direction from the base portion, the receivable portion extends along the second direction from the wall, and the receiver is defined by a space surrounded by the base portion, the wall, and the receivable portion.

19. The connector assembly as recited in claim 18, wherein the wall extends along the first direction from an end of the base portion in the second direction, the receivable portion extends along the second direction from an end of the wall in the first direction, and the base portion, the wall, and the receivable portion form a hook-shape on a plane defined by the first direction and the second direction.

20. The connector assembly as recited in claim 12, wherein the first connector is mounted on a circuit board, the first contact includes a fixing portion fixed to the circuit board, and the first housing is configured to hold the first contact in a state in which the fixing portion is exposed.

21. The connector assembly as recited in claim 20, wherein the first housing further includes a plate extending at least along the second direction, and the support portion extends along the first direction from the plate and supports the overhanging portion so that the overhanging portion and the plate are spaced from each other.

22. The connector assembly as recited in claim 12, wherein the overhanging portion extends along the second direction from an end of the support portion in the first direction.

23. The connector assembly as recited in claim 22, wherein the support portion has a rectangular cross-section on a plane defined by the first direction and the second direction.

24. The connector assembly as recited in claim 22, wherein the support portion has an L-shaped cross-section on a plane defined by the first direction and the second direction.

25. A connector assembly comprising:

a first connector including a first contact having a first contact portion and a first housing configured to hold the first contact;

a second connector matable with the first connector, the second connector including a second contact having a second contact portion that is brought into contact with the first contact portion and a second housing configured to hold the second contact;

a positioner operable to position the second contact portion in a first direction so that the second contact portion corresponds to the first contact portion when the second connector is moved relative to the first connector along the first direction; and a movement guide operable to guide a relative movement of the second connector relative to the first connector along a second direction perpendicular to the first direction in a state in which the second contact portion has been positioned in the first direction until the second contact portion is brought into contact with the first contact portion;

wherein the first connector has the same structure as the second connector.

26. A connector assembly comprising:

a first connector including a first contact having a first contact portion and a first housing configured to hold the first contact;

a second connector matable with the first connector, the second connector including a second contact having a second contact portion that is brought into contact with the first contact portion and a second housing configured to hold the second contact;

a positioner operable to position the second contact portion in a first direction so that the second contact portion corresponds to the first contact portion when the second connector is moved relative to the first connector along the first direction; and a movement guide operable to guide a relative movement of the second connector relative to the first connector along a second direction perpendicular to the first direction in a state in which the second contact portion has been positioned in the first direction until the second contact portion is brought into contact with the first contact portion;

wherein the first housing includes an overhanging portion extending along the second direction and a support portion configured to support the overhanging portion, the overhanging portion and the support portion defining a receptacle portion;

wherein the second housing includes a receivable portion that can be received in the receptacle portion;

wherein the first contact portion contacts the second contact portion when the receivable portion has been received in the receptacle portion;

wherein the second housing includes the receivable portion and a receiver that can receive the overhanging portion;

wherein the overhanging portion is received in the receiver in a state in which the receivable portion has been received in the receptacle portion;

wherein the second housing includes a base portion extending along the second direction and a wall extending along the first direction from the base portion;

wherein the receivable portion extends along the second direction from the wall;

wherein the receiver is defined by a space surrounded by the base portion, the wall, and the receivable portion;

wherein the wall extends along the first direction from an end of the base portion in the second direction;

wherein the receivable portion extends along the second direction from an end of the wall in the first direction; and wherein the base portion, the wall, and the receivable portion form a hook-shape on a plane defined by the first direction and the second direction.

27. A connector assembly comprising:

a first connector including a first contact having a first contact portion and a first housing configured to hold the first contact;

a second connector matable with the first connector, the second connector including a second contact having a second contact portion that is brought into contact with the first contact portion and a second housing configured to hold the second contact;

a positioner operable to position the second contact portion in a first direction so that the second contact portion corresponds to the first contact portion when the second connector is moved relative to the first connector along the first direction; and a movement guide operable to guide a relative movement of the second connector relative to the first connector along a second direction perpendicular to the first direction in a state in which the second contact portion has been positioned in the first direction until the second contact portion is brought into contact with the first contact portion;

wherein the first housing includes an overhanging portion extending along the second direction and a support portion configured to support the overhanging portion, the overhanging portion and the support portion defining a receptacle portion;

wherein the second housing includes a receivable portion that can be received in the receptacle portion;

wherein the first contact portion contacts the second contact portion when the receivable portion has been received in the receptacle portion;

wherein the second housing includes the receivable portion and a receiver that can receive the overhanging portion;

wherein the overhanging portion is received in the receiver in a state in which the receivable portion has been received in the receptacle portion; and wherein the second housing is produced by melting and integrating a locator member configured to hold the second contact and a space defining member configured to define the receiver, the locator member and the space defining member having insulating characteristic.

28. A connector assembly comprising:

a first connector including a first contact having a first contact portion and a first housing configured to hold the first contact;

a second connector matable with the first connector, the second connector including a second contact having a second contact portion that is brought into contact with the first contact portion and a second housing configured to hold the second contact;

a positioner operable to position the second contact portion in a first direction so that the second contact portion corresponds to the first contact portion when the second connector is moved relative to the first connector along the first direction; and a movement guide operable to guide a relative movement of the second connector relative to the first connector along a second direction perpendicular to the first direction in a state in which the second contact portion has been positioned in the first direction until the second contact portion is brought into contact with the first contact portion;

wherein the first housing includes an overhanging portion extending along the second direction and a support portion configured to support the overhanging portion, the overhanging portion and the support portion defining a receptacle portion;

wherein the second housing includes a receivable portion that can be received in the receptacle portion;

wherein the first contact portion contacts the second contact portion when the receivable portion has been received in the receptacle portion;

wherein the first connector is mounted on a circuit board;

wherein the first contact includes a fixing portion fixed to the circuit board; and wherein the first housing is configured to hold the first contact in a state in which the fixing portion is exposed.

29. The connector assembly as recited in claim 28, wherein the first housing further includes a plate extending at least along the second direction, and wherein the support portion extends along the first direction from the plate and supports the overhanging portion so that the overhanging portion and the plate are spaced from each other.

30. A connector assembly comprising:

a first connector including a first contact having a first contact portion and a first housing configured to hold the first contact;

a second connector matable with the first connector, the second connector including a second contact having a second contact portion that is brought into contact with the first contact portion and a second housing configured to hold the second contact;

a positioner operable to position the second contact portion in a first direction so that the second contact portion corresponds to the first contact portion when the second connector is moved relative to the first connector along the first direction; and a movement guide operable to guide a relative movement of the second connector relative to the first connector along a second direction perpendicular to the first direction in a state in which the second contact portion has been positioned in the first direction until the second contact portion is brought into contact with the first contact portion;

wherein the first housing includes an overhanging portion extending along the second direction and a support portion configured to support the overhanging portion, the overhanging portion and the support portion defining a receptacle portion;

wherein the second housing includes a receivable portion that can be received in the receptacle portion;

wherein the first contact portion contacts the second contact portion when the receivable portion has been received in the receptacle portion;

wherein the overhanging portion has two surfaces in the first direction;

wherein the first contact portion is exposed on at least one of the two surfaces of the overhanging portion; and wherein the second contact portion has a hook-shape such as to sandwich the first contact portion or the first contact portion and the overhanging portion in the first direction for establishing connection with the first contact portion.

31. A connector assembly comprising:

a first connector including a first contact having a first contact portion and a first housing configured to hold the first contact;

a second connector matable with the first connector, the second connector including a second contact having a second contact portion that is brought into contact with the first contact portion and a second housing configured to hold the second contact;

a positioner operable to position the second contact portion in a first direction so that the second contact portion corresponds to the first contact portion when the second connector is moved relative to the first connector along the first direction; and a movement guide operable to guide a relative movement of the second connector relative to the first connector along a second direction perpendicular to the first direction in a state in which the second contact portion has been positioned in the first direction until the second contact portion is brought into contact with the first contact portion;

wherein the second connector has a lock member including a rotatable shaft rotatably held by the second housing and a pusher provided at a location spaced from the rotatable shaft by a predetermined distance;

wherein the first housing includes a pressure application portion against which the pusher is pressed by rotation of the lock member; and wherein the lock member is operable to move the second connector relative to the first connector with a reaction force from the pusher when the pusher is pressed against the pressure application portion.

32. A connector assembly comprising:

a first connector including a first contact having a first contact portion and a first housing configured to hold the first contact;

a second connector matable with the first connector, the second connector including a second contact having a second contact portion that is brought into contact with the first contact portion and a second housing configured to hold the second contact;

a positioner operable to position the second contact portion in a first direction so that the second contact portion corresponds to the first contact portion when the second connector is moved relative to the first connector along the first direction; and a movement guide operable to guide a relative movement of the second connector relative to the first connector along a second direction perpendicular to the first direction in a state in which the second contact portion has been positioned in the first direction until the second contact portion is brought into contact with the first contact portion;

wherein the second connector has a lock member including a rotatable shaft rotatably held by the second housing and an engaging portion provided at a location spaced from the rotatable shaft by a predetermined distance;

wherein the first housing includes an engagement portion with which the engaging portion is engaged by rotation of the lock member; and wherein the second connector is locked with respect to the first connector by the engagement of the engaging portion with the engagement portion.

* * * * *

UNITED STATES PATENT AND TRADEMARK OFFICE

CERTIFICATE OF CORRECTION

PATENT NO. : 7,927,122 B2
APPLICATION NO. : 12/802788
DATED : April 19, 2011
INVENTOR(S) : Yamaji et al.

It is certified that error appears in the above-identified patent and that said Letters Patent is hereby corrected as shown below:

In Column 15, line 40 (Line 26 in Claim 1) after the word "contact", please change "Portion" to correctly read: --portion--.

Signed and Sealed this
Thirteenth Day of September, 2011

David J. Kappos

David J. Kappos
*Director of the United States Patent and Trademark Office*